US009194602B2

(12) United States Patent
Hu et al.

(10) Patent No.: US 9,194,602 B2
(45) Date of Patent: Nov. 24, 2015

(54) VENTILATION FAN MOUNTING STRUCTURE

(71) Applicants: Panasonic Ecology Systems Guangdong Co., Ltd., Foshan, Guangdong (CN); Panasonic Corporation, Osaka (JP)

(72) Inventors: Yiheng Hu, Guangdong (CN); Guancheng Hou, Guangdong (CN); Bodong Zhong, Guangdong (CN); Shouyong Gao, Guangdong (CN); Yanbiao He, Guangdong (CN); Daisuke Tsubosa, Aichi (JP)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 0 days.

(21) Appl. No.: 14/465,306

(22) Filed: Aug. 21, 2014

(65) Prior Publication Data

US 2015/0060638 A1 Mar. 5, 2015

(30) Foreign Application Priority Data

Sep. 3, 2013 (CN) ..... 2013 2 0544433
Jan. 20, 2014 (CN) ..... 2014 2 0034842

(51) Int. Cl.

| | |
|---|---|
| ***F16M 11/00*** | (2006.01) |
| ***F24F 13/20*** | (2006.01) |
| ***F24F 13/32*** | (2006.01) |

(52) U.S. Cl.
CPC ..... *F24F 13/20* (2013.01); *F24F 13/32* (2013.01); *F24F 2013/205* (2013.01)

(58) Field of Classification Search
CPC ..... F24F 13/20; F24F 2013/205; F24F 13/32
See application file for complete search history.

(56) References Cited

U.S. PATENT DOCUMENTS

| | | | | |
|---|---|---|---|---|
| 6,729,083 | B1 * | 5/2004 | Soyko | E04D 13/0305 248/298.1 |
| 8,961,126 | B1 * | 2/2015 | Tom | F21V 29/02 362/368 |
| 2013/0026334 | A1 * | 1/2013 | Long | F04D 25/08 248/675 |

* cited by examiner

*Primary Examiner* — Amy Sterling
(74) *Attorney, Agent, or Firm* — RatnerPrestia

(57) ABSTRACT

A ventilation fan mounting structure includes a bracket assembly which is to be mounted to opposite two side flanges of a ventilation fan and includes a first bracket and a second bracket each formed in a U shape, wherein each of the first bracket and the second bracket includes two side members and a connection member connecting the two side members, the connection members and the side members of the first and second brackets are connected to each other by shafts, the side members are rotatable around the shafts, and a position-limit portion is disposed to the connection member to limit a rotation range of the side member. With the ventilation fan mounting structure according to the embodiments of the present invention, the mounting of the ventilation fan can be simply and conveniently completed even if the distance between the ceiling and the roof is small.

24 Claims, 23 Drawing Sheets

VENTILATION FAN MOUNTING STRUCTURE

CROSS-REFERENCE TO RELATED APPLICATIONS

This application claims the benefit of Chinese patent application No. 201320544433.4, filed on Sep. 3, 2013 and Chinese patent application No. 201420034842.4, filed on Jan. 20, 2014 with the State Intellectual Property Office of China and the inventions of which are incorporated herein in its entirety by reference.

BACKGROUND OF THE INVENTION

1. Field of the Invention

The present invention relates to a ventilation fan, and particularly to a ventilation fan mounting structure.

2. Description of the Related Art

Generally, the conventional ventilation fan comprises a quadrate ventilation fan frame and parts such as a snail shell and a fan blade motor which are mounted inside the ventilation fan frame.

In order to mount the ventilation fan, a bracket assembly is provided in the prior art. FIG. 1A is a schematic view of the bracket assembly, and FIG. 1B is a schematic view showing mounting of the bracket assembly when only one opening having the same size as the ventilation fan frame is reserved in a ceiling. As shown in FIGS. 1A and 1B, the bracket assembly 4 is composed of a first bracket 5, a second bracket 6, and a quadrate ventilation fan mounting frame 9. Each of the first bracket 5 and the second bracket 6 has a U shape and is composed of two side members 1 opposite to each other and a connection member 2 connecting the two side members 1. In other words, the two side members 1 are located on both sides of the connection member 2. An open groove 7 is formed by folding upper and lower edges of each of a pair of opposing side members of the ventilation fan mounting frame 9 towards an outside of the ventilation fan mounting frame 9 to be opposite to each other.

After the first bracket 5 and the second bracket 6 are respectively inserted into the grooves 7 from both ends of the grooves 7 of the ventilation fan mounting frame 9 so as to be engaged integrally, a quadrate is formed by the connection members 2 and the side members 1 of the first bracket 5 and the second bracket 6 around the ventilation fan mounting frame 9. Engagement parts 8 for mounting the ventilation fan frame are disposed on the opposite side members of the ventilation fan mounting frame 9 where the grooves 7 are disposed, accordingly, the ventilation fan frame can be mounted in the ventilation fan mounting frame 9 through the engagement parts 8.

If a user wants to replace the ventilation fan when the ceiling and the ventilation fan have been mounted, when mounting a new ventilation fan with a bracket assembly such as that in the abovementioned prior art, a louver and the old ventilation fan are firstly removed, and here, only an opening 1000 having the same size as the ventilation fan frame is reserved in the ceiling. Provided that the ceiling is not detached, the user needs to pass the bracket assembly 4 though the opening 1000 of the ceiling and fix it to joists, and then pass a new ventilation fan frame through the opening 1000 of the ceiling and mount it in the ventilation fan mounting frame 9.

The ceiling opening 1000 is equivalent in size to a cross section of the ventilation fan frame and the bracket assembly 4 is greater than the cross sectional area of the ventilation fan frame. In other words, the bracket assembly 4 is greater than the ceiling opening 1000 in size. Therefore, when the user passes the bracket assembly 4 through the ceiling opening 1000, he needs to position the connection members 2 of the first bracket 5 and the second bracket 6 relatively obliquely while the side members 1 on both sides of the connection members 2 are also relatively obliquely positioned. Only in this way can he insert the bracket assembly 4 into the ceiling opening 1000. In other words, only when one of the connection members 2 of the first bracket 5 and the second bracket 6 is lower than the other, and one of the side members 1 on both sides of the connection members 2 is lower than the other, can the bracket assembly 4 be inserted into the ceiling opening 1000.

When a distance between the ceiling and a roof is set to be small, after being obliquely inserted into the ceiling opening 1000, the bracket assembly 4 will come into contact with the roof and be blocked by the roof. In this case, the bracket assembly 4 cannot be restored to a horizontally positioned state due to insufficient space and thus the mounting cannot be continued.

SUMMARY OF THE INVENTION

It is an object of the present invention to provide a ventilation fan mounting structure, by which the mounting of the ventilation fan can be simply and conveniently completed even if the distance between the ceiling and the roof is small.

In order to achieve the above object, there is provided a ventilation fan mounting structure comprises a bracket assembly which is to be mounted to two opposite side flanges of a ventilation fan and includes a first bracket and a second bracket each formed in a U shape, wherein each of the first bracket and the second bracket includes two side members and a connection member connecting the two side members, the connection members and the side members of the first and second brackets are connected to each other by shafts, the side members are rotatable around the shafts, and a position-limit portion is disposed to the connection member to limit a rotation range of the side member.

The side member of either of the first and second brackets comprises a first connection part connected to the connection member and a second connection part connected to the side member of the other of the first and second brackets, and the first connection part and the second connection part are formed in an L shape.

Rivets serve as the shafts, the connection members and the first connection parts of the side members of the first and second brackets are connected with each other through the rivets, and the side members are rotatable around the rivets.

The position-limit portion is a bent sheet bent from an upper edge of the connection member towards an inside of the bracket assembly.

The bent sheet is perpendicular to the connection member.

The connection member is integrally formed with an elongated protrusion.

The lower edges of the connection members of the first and second brackets are provided with first stop sheets, and the first stop sheets are bendable towards an outside of the bracket assembly, and are flush with the lower edges of the connection members after they are bent.

The second connection parts of the two side members of each of the first and second brackets are each formed in a C-shaped open groove in such a way that left and right edges extending in a vertical direction are bent into a horizontal direction so as to form two horizontal edge surfaces, and the C-shaped open groove is provided with a plurality of elongated openings; and when the first bracket and the second bracket are integrally engaged to constitute the bracket assembly, the two edges surfaces, two side surfaces, and a bottom surface of the groove of either of the first and second brackets of the bracket assembly can be surrounded by the two edges surfaces, two side surfaces, and a bottom surface of the groove of the other of the first and second brackets and are slidably mounted within the groove of the other of the brackets.

Flangings perpendicular to the bottom surface of the groove are disposed on both sides of the elongated opening which extend in a longitudinal direction.

The first bracket and the second bracket have the same structure.

The bracket assembly is configured to be mounted to the ventilation fan; the ventilation fan comprises a ventilation fan frame formed with a flange on its indoor opening side, and an adapter plate detachable from the ventilation fan frame; and, a flange perpendicular to the adapter plate is disposed on a bottom of the adapter plate, and both the flange of the ventilation fan frame and the flange of the adapter plate are provided with mounting holes.

A hook sheet extending upwards towards the ventilation fan frame side is disposed on a back surface of the adapter plate, an elastic sheet is disposed on a side surface of the ventilation fan frame attaching to the adapter plate, and an engagement hole is disposed under the elastic sheet.

A protrusion protruding towards the ventilation fan frame side is disposed on the adapter plate of the ventilation fan near a top of the adapter plate, and an opening into which the protrusion is engaged is disposed on a side surface of the ventilation fan frame attaching to the adapter plate.

A positioning groove of the adapter plate is formed in such a way that two side edges of the adapter plate extending in a width direction are bent towards the ventilation fan frame side and then bend towards an inside of the adapter plate, and a positioning sheet is formed in such a way that two side edges of a side surface, which is connected to the adapter plate, of the ventilation fan frame are bent towards an outside of the ventilation fan frame and then bent in an opposite direction to the adapter plate.

The number of the positioning sheets is two or more.

An upper first opening and a lower second opening are disposed in the adapter plate near the flange of the adapter plate, and an upper third opening and a lower fourth opening are disposed in a sidewall of the ventilation fan frame attaching to the adapter plate.

Extension sheets extend upwards from tops of the first connection parts of the first and second brackets. The extension sheets are provided with openings.

The lower edges of the connection members of the first and second brackets are provided with first stop sheets, and the first stop sheets are bendable towards an outside of the bracket assembly, and are flush with the lower edges of the connection members after they are bent.

The ventilation fan mounting structure is fixed between a pair of joists, and fixing wood strips perpendicular to the joists are disposed under the joists and are fixed to the joists, the connection members of the first and second brackets are provided with second stop sheets bendable towards an outside of the bracket assembly, and a distance between an upper edge of the second stop sheet and the lower edge of the connection member is equal to a height of the fixing wood strip.

Fifth openings through which screws passes are disposed in the first connection parts of the side members of the first and second brackets on an inside of the bracket assembly.

Sixth openings are disposed in positions corresponding to the fifth openings in the connection members of the first and second brackets.

The first connection parts of the side members of the first and second brackets are provided with screw engaging parts protruding towards an inside of the bracket assembly, and the fifth openings are disposed in the surfaces, opposite to the ventilation fan, of the screw engaging parts.

DETAILED DESCRIPTION OF THE EMBODIMENTS

Figure 1A:
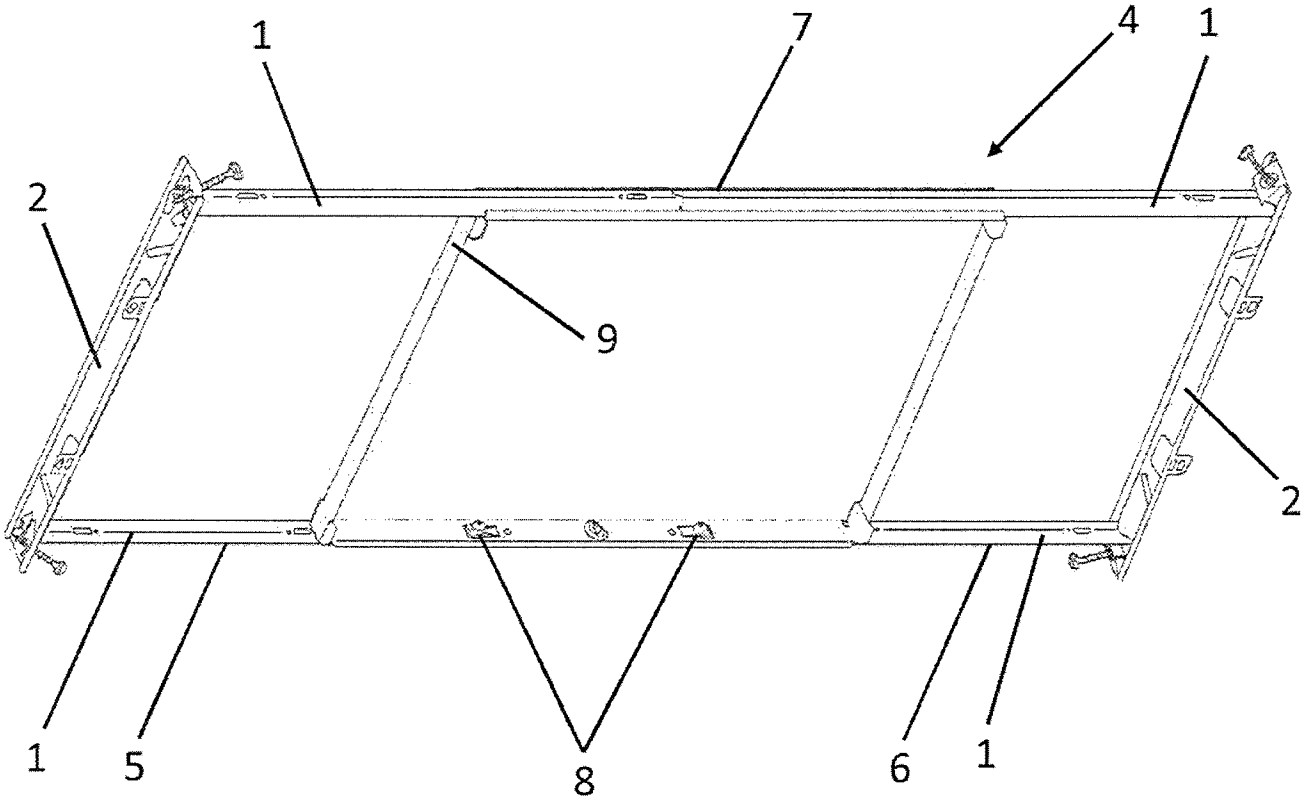
Fig. 1A (PRIOR ART)
FIG. 1A is a schematic view of an existing bracket assembly.
Figure 1B:
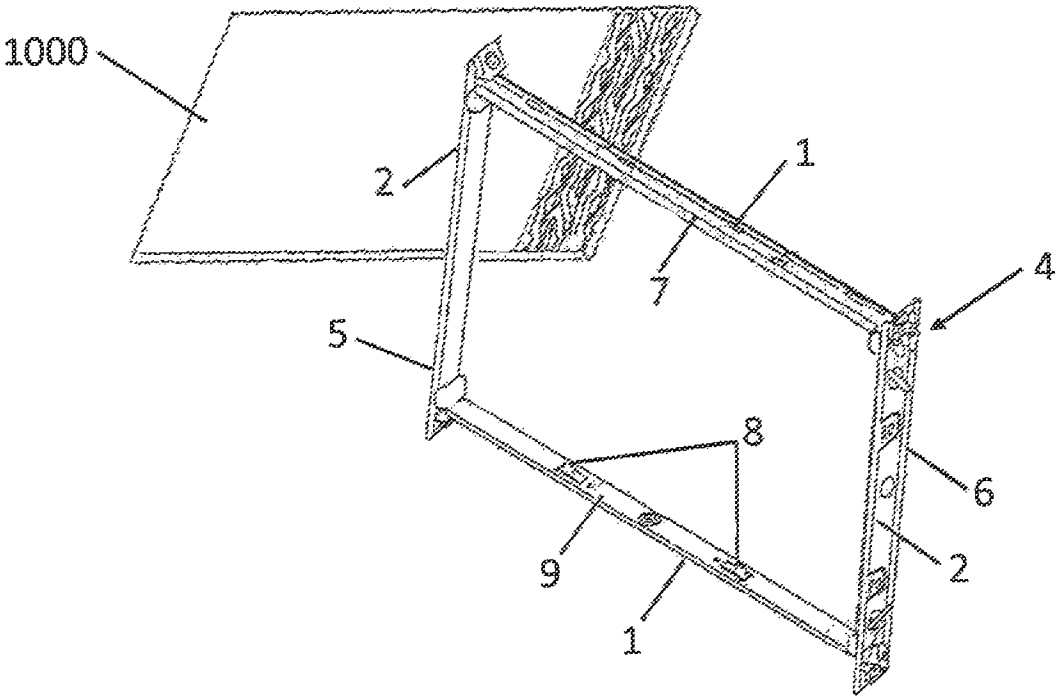
Fig. 1B PRIOR ART
FIG. 1B is a schematic view showing mounting of the existing bracket assembly when only one opening having the same size as a ventilation fan frame is reserved in a ceiling.
Figure 2:
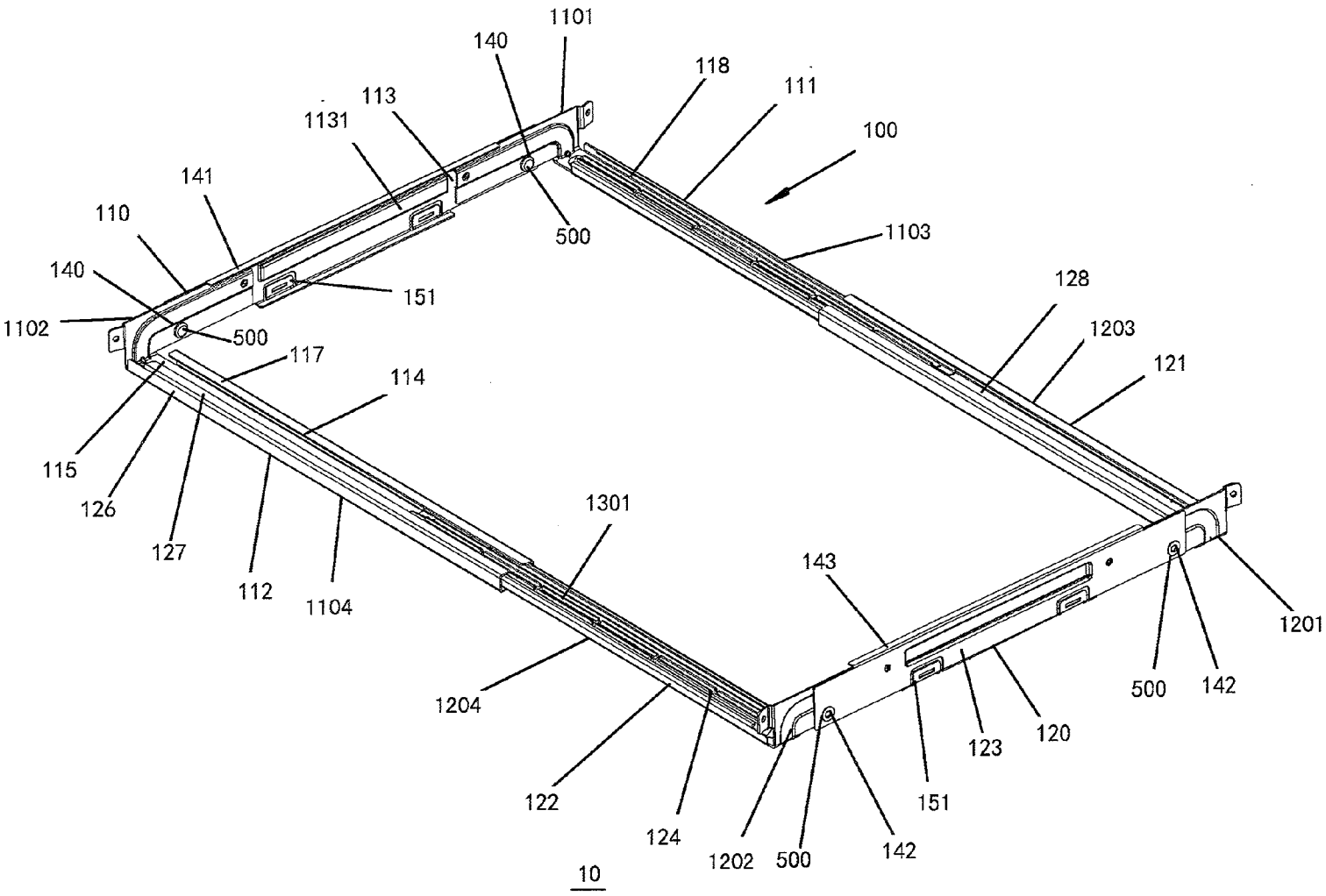
FIG. 2 is a schematic view of a bracket assembly according to a first embodiment of the present invention.
Figure 3A:
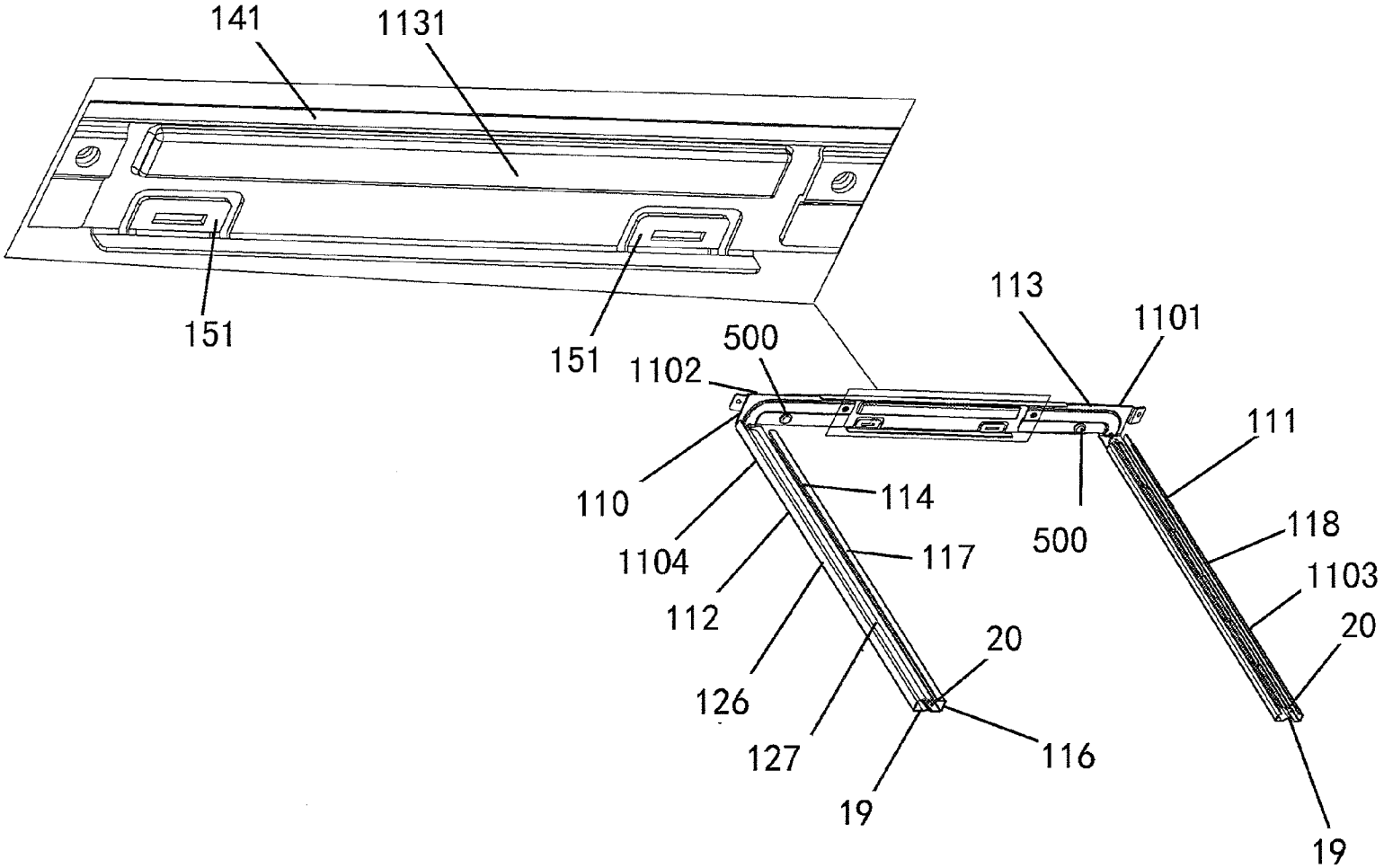
FIGS. 3A and 3B are partially enlarged schematic views of the bracket assembly according to the first embodiment of the present invention.
Figure 3B:
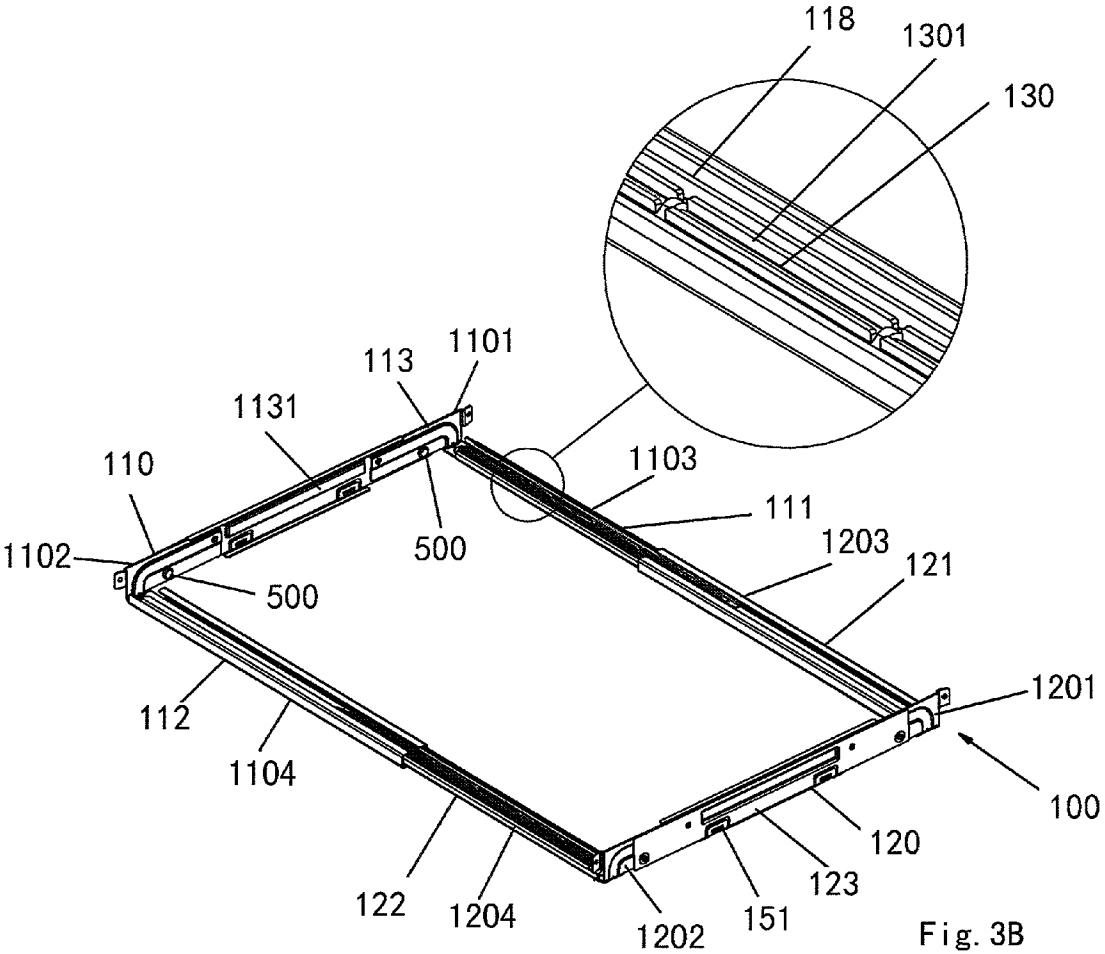
Figure 4A:
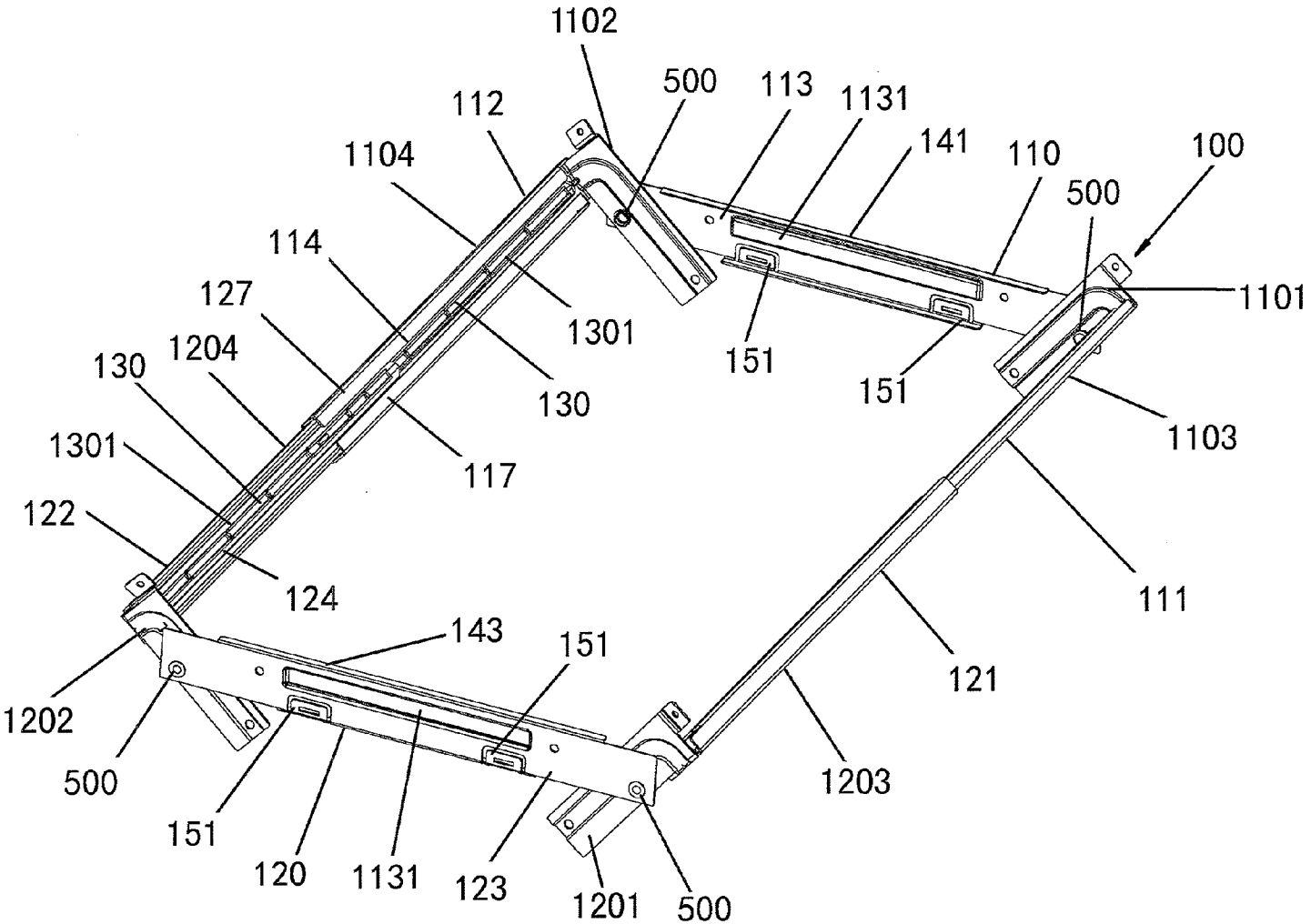
FIG. 4A is a schematic view showing rotation of side members of the bracket assembly according to the first embodiment of the present invention.
Figure 4B:
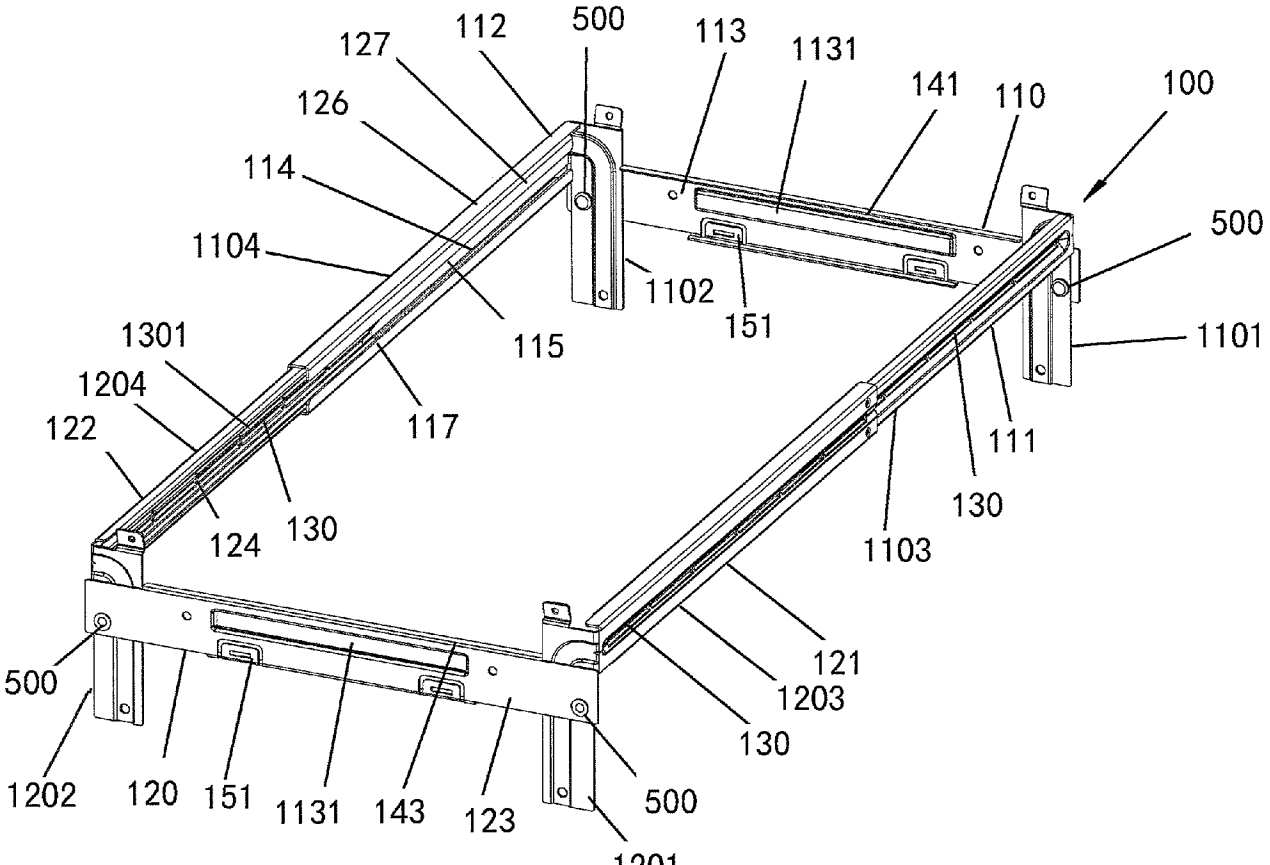
FIG. 4B is another schematic view showing rotation of the side members of the bracket assembly according to the first embodiment of the present invention.
Figure 5A:
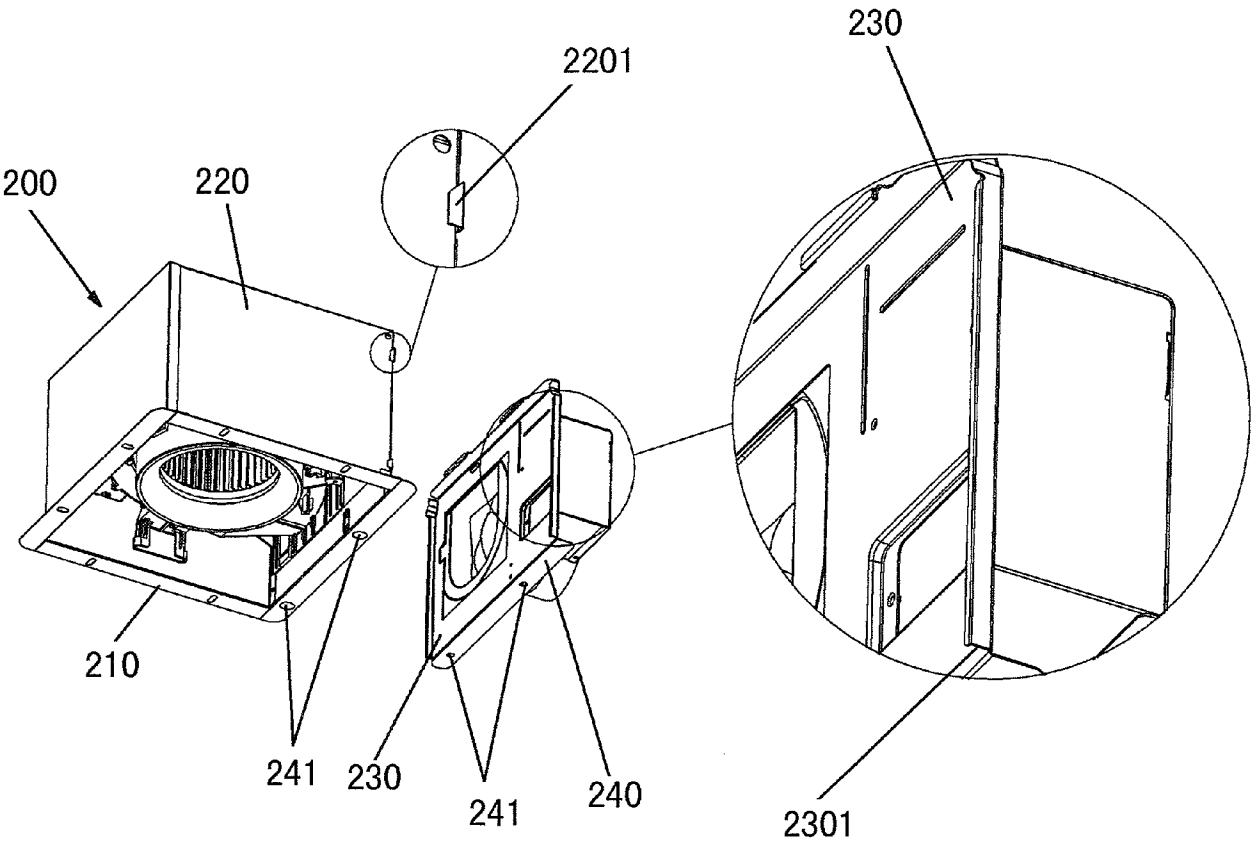
FIG. 5A is a schematic view of a ventilation fan according to an embodiment of the present invention.
Figure 5B:
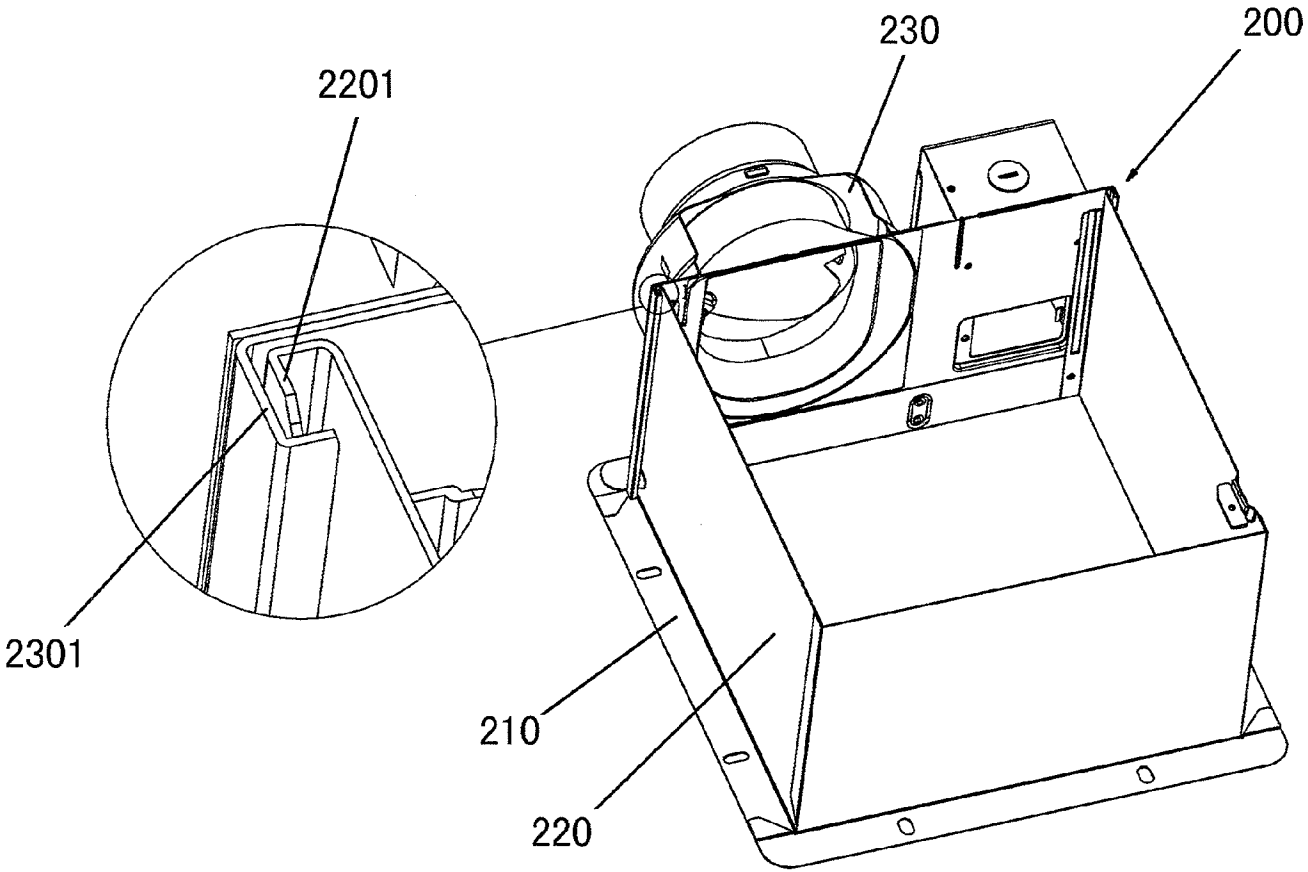
FIG. 5B is a cross sectional view of the ventilation fan according to the embodiment of the present invention.

FIG. 2 is a schematic view of a bracket assembly according to an embodiment of the present invention; FIGS. 3A and 3B are partially enlarged schematic views of the bracket assembly according to the embodiment of the present invention; FIGS. 4A and 4B are schematic views showing rotation of side members of the bracket assembly according to the embodiment of the present invention; FIG. 5A is a schematic view of a ventilation fan according to the embodiment of the present invention; and FIG. 5B is a cross sectional view of the ventilation fan according to the embodiment of the present invention.

As shown in the figures, a ventilation fan mounting structure 10 comprises a bracket assembly 100 which is to be mounted to two opposite side flanges 210 of a ventilation fan and which includes a first bracket 110 and a second bracket 120 each formed in a U shape. The first bracket 110 includes two side members 111 and 112 and a connection member 113 connecting the two side members 111 and 112. The second bracket 120 includes two side members 121 and 122 and a connection member 123 connecting the two side members 121 and 122. The side members 111 and 112 of the first bracket 110 comprise first connection parts 1101 and 1102 connected to the connection member 113 and second connection parts 1103 and 1104 connected to the side members 121 and 122 of the second bracket 120, the first connection part 1101 and the second connection part 1103 are formed in an L shape, and the first connection part 1102 and the second connection part 1104 are formed in an L shape.

The side members 121 and 122 of the second bracket 120 comprise first connection parts 1201 and 1202 connected to the connection member 123 and second connection parts 1203 and 1204 connected to the side members 111 and 112 of the first bracket 110, the first connection part 1201 and the second connection part 1203 are formed in an L shape, and the first connection part 1202 and the second connection part 1204 are formed in an L shape.

The connection members 113 and the first connection parts 1101 and 1102 of the side members 111 and 112 of the first bracket 110 are connected to each other by shafts 140, the side members 111 and 112 are rotatable around the shafts 140, and a position-limit portion 141 is disposed to the connection member 113 to limit a rotation range of each of the side members.

The connection members 123 and the first connection parts 1201 and 1202 of the side members 121 and 122 of the second bracket 120 are connected to each other by shafts 142, the side members 121 and 122 are rotatable around the shafts 142, and a position-limit portion 143 is disposed to the connection member 123 to limit a rotation range of each of the side members 121 and 122. The position-limit portions 141 and 143 are bent sheets bent from upper edges of the connection members 113 and 123 towards an inside of the bracket assembly 100. The bent sheets are perpendicular to the connection members 113 and 123.

In this embodiment, rivets 500 serve as the shafts 140 and 142, the connection member 113 and the first connection parts 1101 and 1102 of the side members 111 and 112 of the first bracket 110 are connected to each other through the rivets 500, and the side members 111 and 112 are rotatable around the rivets 500; and the connection member 123 and the first connection parts 1201 and 1202 of the side members 121 and 122 of the second bracket 120 are connected to each other through the rivets 500, and the side members 121 and 122 are rotatable around the rivets 500.

The bracket assembly 100 according to the embodiment includes the first bracket 110 and the second bracket 120 each formed in the U shape. In other words, the bracket assembly 100 does not include the ventilation fan mounting frame mentioned in the background.

The manner of disposing the rivets 500 to the first bracket 110 is the same as that of disposing the rivets 500 to the second bracket 120. Taking the first bracket 110 as an example, the connection members 113 and the first connection parts 1101 and 1102 of the side members 111 and 112 of the first bracket 110 are connected to each other by the rivets 500. In other words, the connection members 113 and the first connection parts 1101 and 1102 of the side members 111 and 112 of the first bracket 110 are provided with corresponding openings. The rivets 500 are passed through the openings in the connection members 113 and the first connection parts 1101 and 1102 of the side members 111 and 112 and then flangings are formed by pressing ends of the rivets 500, thereby connecting the connection member 113 with the side members 111 and 112.

When a distance between a ceiling and a roof is set to be small, the side members 111, 112, 121, and 122 of the first bracket 110 and the second bracket 120 are rotated towards an inside of the bracket assembly 100 around the rivets 500 as the shaft, so that the first connection parts 1101, 1102, 1201, and 1202 of the side members 111, 112, 121, and 122 are rotated such that they form angles of about 90 degrees with the connection members 113 and 123. Since there is no conventional ventilation fan mounting frame, rotations of the side members 111, 112, 121, and 122 are not obstructed by the ventilation fan mounting frame. After the side members 111, 112, 121, and 122 on both sides of the connection members 113 and 123 are rotated upwards, a distance between the second connection parts 1103 and 1104 of the side members 111 and 112 on both sides of the connection member 113 is reduced, and a distance between the second connection parts 1203 and 1204 of the side members 121 and 122 on both sides of the connection member 123 is reduced. When the distance between the second connection parts 1103 and 1104 of the side members 111 and 112 on both sides of the connection member 113, and the distance between the second connection parts 1203 and 1204 of the side members 121 and 122 on both sides of the connection member 123 are less than a size of a ceiling opening, it is unnecessary to position the second connection parts 1103 and 1104 of the first bracket 110 relatively obliquely and it is either unnecessary to position the second connection parts 1203 and 1204 of the second bracket 120 relatively obliquely. It is only necessary to position the connection members 113 and 123 of the first bracket 110 and the second bracket 120 relatively obliquely so that the bracket assembly 100 can be inserted into the ceiling opening. In other words, so long as one of the connection members 113 and 123 of the first bracket 110 and the second bracket 120 is lower than the other, the bracket assembly 100 can be inserted into the ceiling opening.

For example, the connection member 113 of the first bracket 110 is lower than the connection member 123 of the second bracket 120. In this way, a space required for restoring the bracket assembly 100 to a horizontally positioned state is greatly decreased. Even if the distance between the ceiling and the roof is small, the bracket assembly 100 can be inserted into the ceiling opening by positioning the connection members 113 and 123 of the first bracket 110 and the second bracket 120 relatively obliquely.

After the bracket assembly 100 is completely inserted into the ceiling opening, the mounter can rotate the side members 111, 112, 121, and 122 of the brackets towards an outside of the bracket assembly 100. When the first connection parts 1101, 1102, 1201, and 1202 of the side members 111, 112, 121 and 122 are rotated to their original positions, they will come into contact with the bent sheets which are disposed on the upper edges of the connection members 113 and 123 and are perpendicular to the connection members 113 and 123, and thus be locked so that the rotation is stopped. In this case, the bracket assembly 100 can be fixed to the joists 300.

Furthermore, as shown in FIG. 3A, the lower edges of the connection members 113 and 123 are provided with first stop sheets 151 which are bendable towards an outside of the bracket assembly 100. Before mounting the bracket assembly 100, the first stop sheets 151 are bent towards the outside of the bracket assembly 100 in advance. In other words, the first stop sheets 151 are protruded towards the outside of the bracket assembly 100. When the bracket assembly 100 is mounted to the joists 300, the bent first stop sheets 151 can abut against bottom surfaces of the joists 300 so that a lower edge of the bracket assembly 100 is flush with the bottom surfaces of the joists 300. As a result, the bracket assembly 100 can be easily positioned in a vertical direction.

In addition, the connection member 113 of the first bracket 110 is integrally formed with an elongated protrusion 1131. The protrusion 1131 may be formed by pressing simultaneously when pressing the bracket. The elongated protrusion 1131 can increase the strength of the connection member 113, prevent deformation of the connection member 113, and enhance the mounting stability. The second bracket 120 has the same structure as the first bracket 110.

Further, as shown in FIGS. 2-3B, the second connection parts 1103, 1104, 1203, and 1204 of the side members 111, 112, 121, and 122 of the first bracket 110 and the second bracket 120 are each formed as a C-shaped open groove in such a way that left and right edges extending in a vertical direction are bent into a horizontal direction so as to form two horizontal edge surfaces. Specifically, two edges of outer side edges, extending in a longitudinal direction, of each of the bottom surfaces of the second connection parts 1103, 1104, 1203, and 1204 are first bent vertically upwards to form two side surfaces perpendicular to the bottom surface, and then bent from edges of the two side surfaces towards each other to form the two horizontal edge surfaces which are parallel to the bottom surface of the side member.

The side member 112 of the first bracket 110 is taken as an example for illustration. The outer side edges of the bottom surface 115 of the second connection part 1104 of the side member 112 of the first bracket 110 are bent upwards to form the two side surfaces 116 and 126 which are perpendicular to the bottom surface 115, and edges of the side surfaces 116 and 126 are bent towards each other to form the horizontal edge surfaces 117 and 127. The bottom surface 115, the side surfaces 116 and 126, and the edge surfaces 117 and 127 form the C-shaped open groove.

The abovementioned C-shaped open grooves are further defined in the following description for convenience. The C-shaped open grooves disposed in the second connection parts 1104 and 1103 of the two side members 112 and 111 of the first bracket 110 are the first groove 114 and the second groove 118, respectively. The C-shaped open grooves disposed in the second connection parts 1204 and 1203 of the two side members 122 and 121 of the second bracket 120 are the third groove 124 and the fourth groove 128, respectively. Each of the abovementioned four grooves is provided with a convex surface 19 as an outside surface, and a concave surface 20 as an inside surface. Each of these grooves is provided with a plurality of a horizontally elongated openings 130 passing through the concave surface 20 from the convex surface 19.

The concave surface 20 of the first groove 114 of the first bracket 110 has a greater width than the convex surface 19 of the third groove 124 of the second bracket 120. Therefore, the third groove 124 of the second bracket 120 can be inserted into the first groove 114 from an end of the first groove 114 of the first bracket 110, and the third groove 124 of the second bracket 120 is slidable in the first groove 114 of the first bracket 110. As a result, a length by which the third groove 124 of the second bracket 120 projects from the first groove 114 of the first bracket 110 in the horizontal direction can be adjusted.

In addition, the concave surface 20 of the fourth groove 128 of the second bracket 120 has a greater width than the convex surface 19 of the second groove 118 of the first bracket 110. Therefore, the second groove 118 of the first bracket 110 can be inserted into the fourth groove 128 from an end of the fourth groove 128 of the second bracket 120, and the second groove 118 of the first bracket 110 is slidable in the fourth groove 128 of the second bracket 120. As a result, a length by which the second groove 118 of the first bracket 110 projects from the fourth groove 128 of the second bracket 120 in the horizontal direction can be adjusted. In other words, when the first bracket 110 and the second bracket 120 are integrally engaged to constitute the bracket assembly 100, two edges surfaces, two side surfaces, and a bottom surface of the groove 124 of the second bracket 120 of the bracket assembly 100 can be surrounded by two edges surfaces 117 and 127, two side surfaces 116 and 126, and a bottom surface 115 of the groove 114 of the first bracket 110, and are slidably mounted within the groove 114 of the first bracket 110; and two edges surfaces, two side surfaces, and a bottom surface of the groove 114 of the first bracket 110 also can be surrounded by two edges surfaces, two side surfaces, and a bottom surface of the groove 124 of the second bracket 120, and are slidably mounted within the groove 124 of the second bracket 120. In short, the two edges surfaces, the two side surfaces, and the bottom surface of the groove of any of the brackets of the bracket assembly 100 can be surrounded by the two edges surfaces, the two side surfaces, and the bottom surface of the groove of the other of the brackets and are slidably mounted within the groove of the other of the brackets.

As described above, the two side members 111 and 112 of the first bracket 110 and the two side members 121 and 122 of the second bracket 120 are formed with the wide grooves and the narrow grooves, respectively. Therefore, the first bracket 110 and the second bracket 120 may have the same structure and may be formed by one set of molds so as to save the fabricating cost of the molds and also facilitate the mounting.

On the other hand, since the two brackets can be connected together through the grooves, it is not necessary to pass screws through the two brackets so as to facilitate mounting, either. Since the two side members 111 and 112 of the first bracket 110 and the two side members 121 and 122 of the second bracket 120 are connected together through the connection members 113 and 123, respectively, the first groove 114 of the first bracket 110 can be slid while the second groove 118 of the first bracket 110 is sliding, and the fourth groove 128 of the second bracket 120 can be slid while the third groove 124 of the second bracket 120 is sliding. Therefore, it is very convenient to adjust a length of the bracket assembly 100 formed by engaging the first bracket 110 with the second bracket 120.

Figure 6:
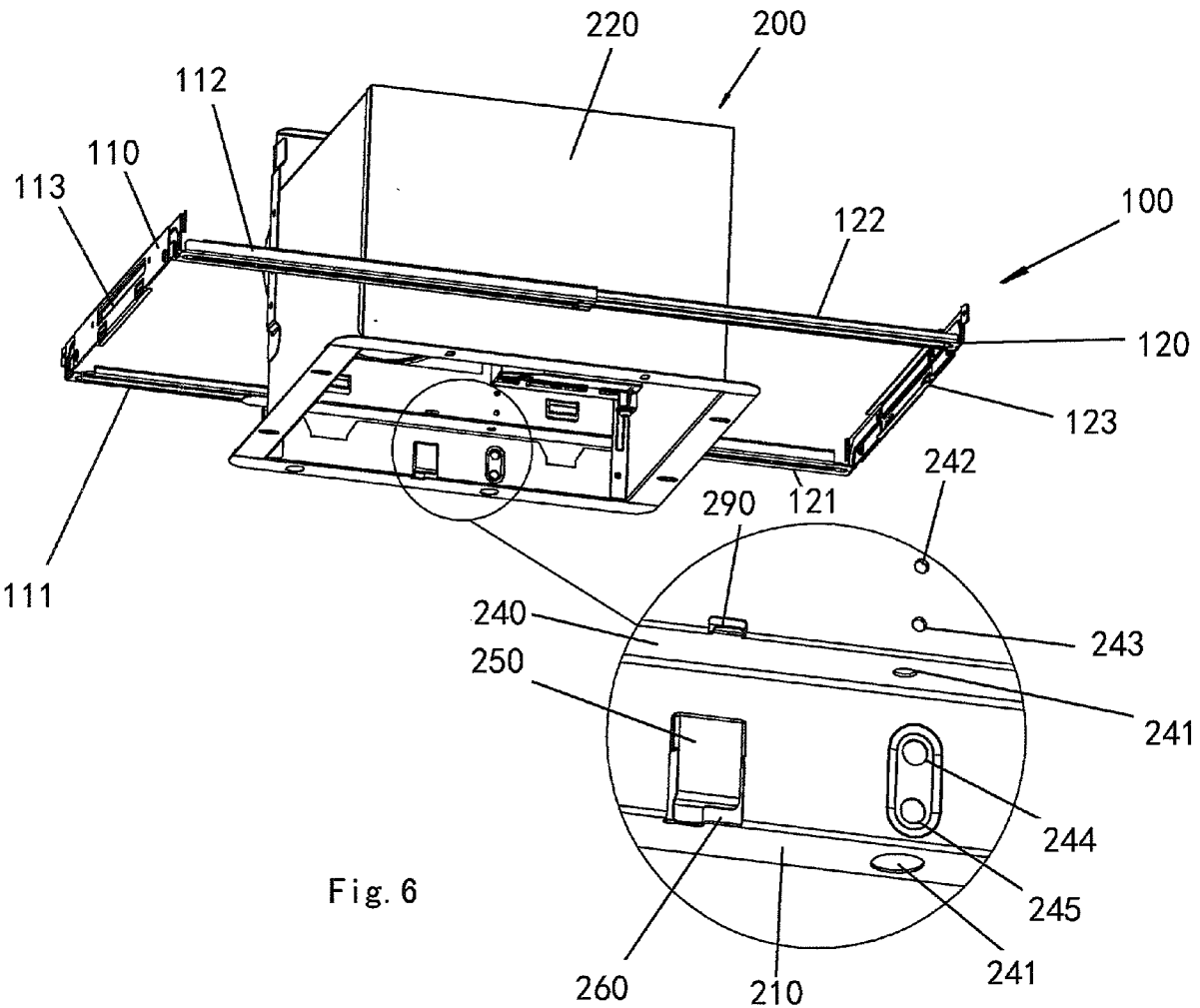
FIG. 6 is a schematic view showing a process in which a ventilation fan frame is temporarily fixed to an adapter plate by a temporary fixing structure in an embodiment of the present invention.
Figure 7:
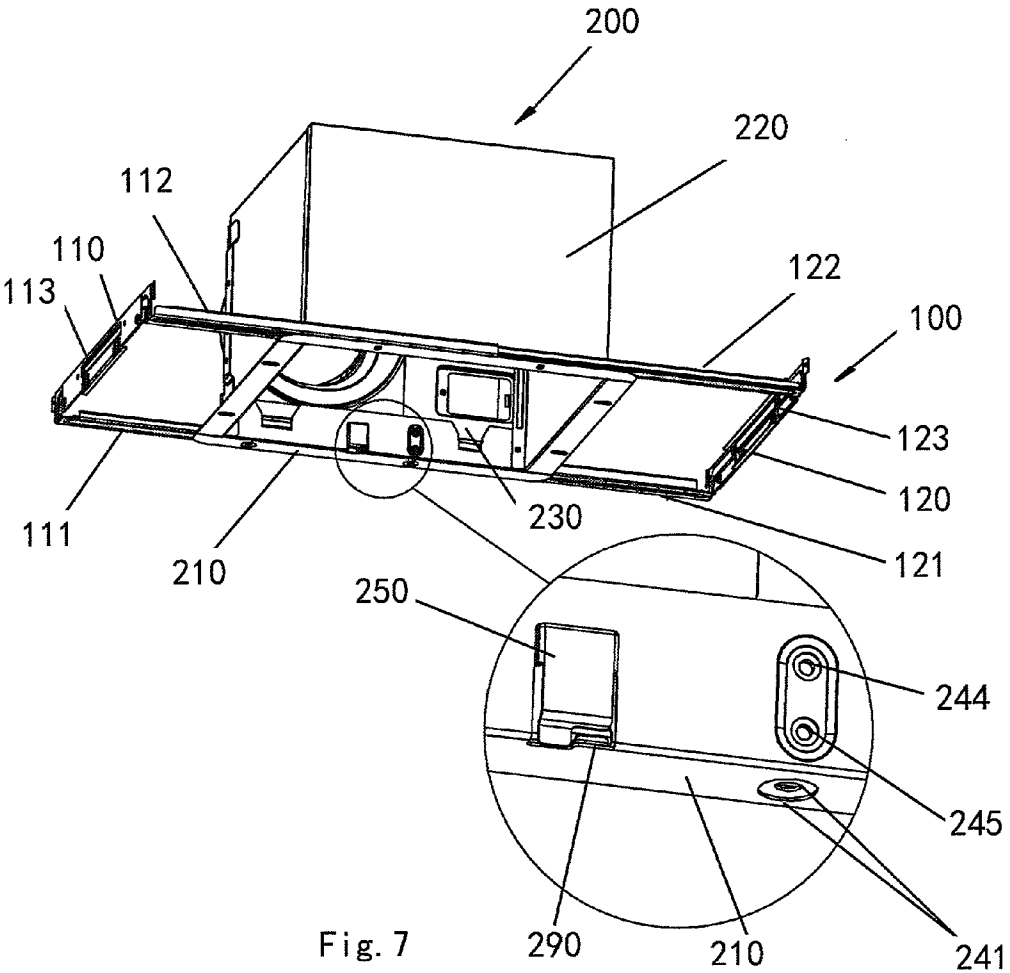
FIG. 7 is another schematic view showing the process in which the ventilation fan frame is temporarily fixed to the adapter plate by the temporary fixing structure in the embodiment of the present invention.
Figure 8:
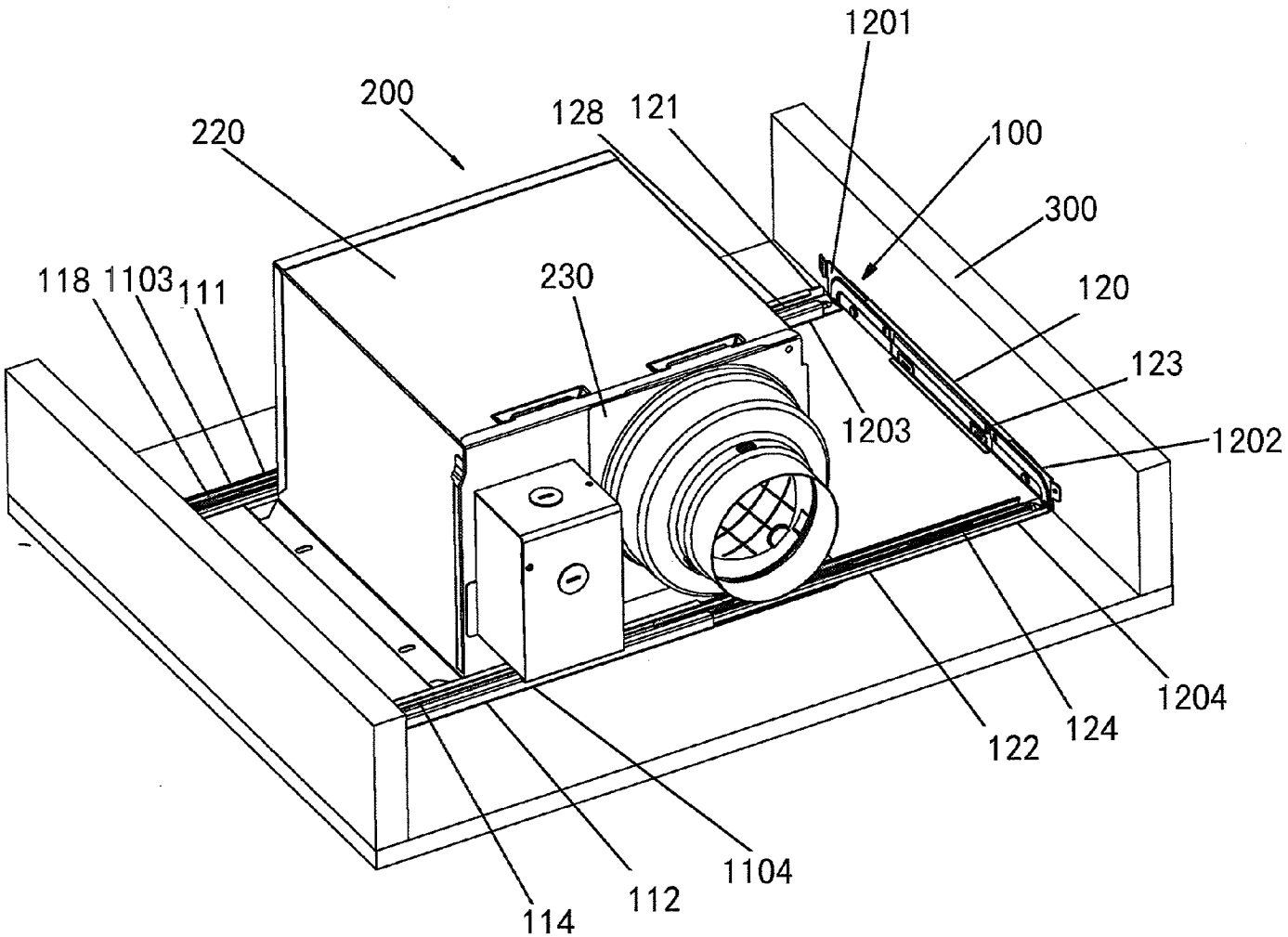
FIG. 8 is a schematic view of the ventilation fan after the mounting is completed, according to an embodiment of the present invention.
Figure 9:
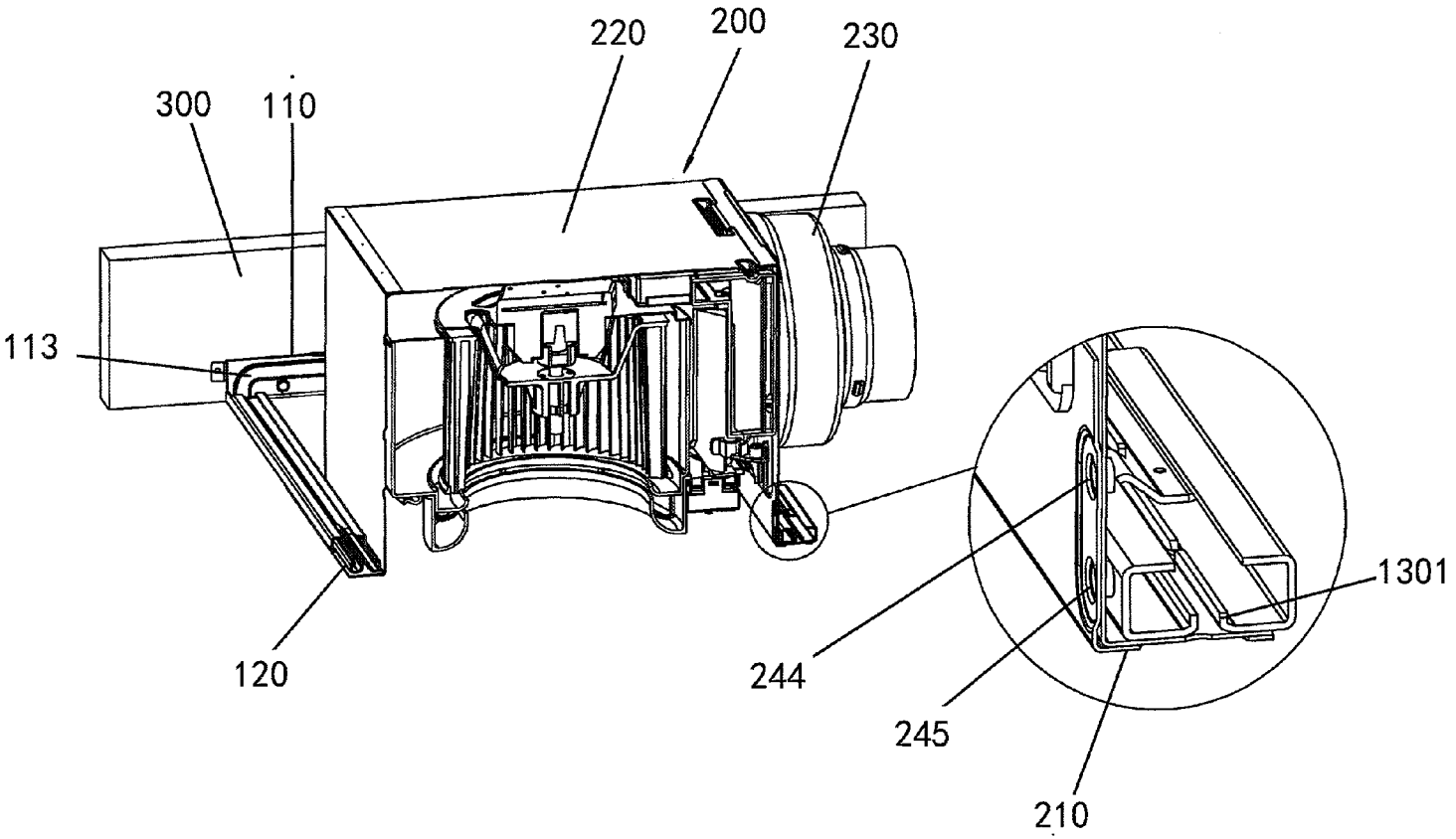
FIG. 9 is a schematic view showing a mounting of the ventilation fan in a new house in which a ceiling is not mounted yet, according to an embodiment of the present invention.

FIG. 6 is a schematic view showing a process in which a ventilation fan frame is temporarily fixed to an adapter plate by a temporary fixing structure in an embodiment of the present invention; FIG. 7 is another schematic view showing the process in which the ventilation fan frame is temporarily fixed to the adapter plate by the temporary fixing structure in the embodiment of the present invention; FIG. 8 is a schematic view of the ventilation fan after the mounting is completed, according to an embodiment of the present invention; and FIG. 9 is a schematic view showing a mounting of the ventilation fan in a new house in which a ceiling is not mounted yet, according to an embodiment of the present invention.

As shown in FIGS. 3B and 6-9, the bracket assembly 100 is mounted to the ventilation fan 200. The ventilation fan 200 comprises a ventilation fan frame 220 formed with a flange 210 on its indoor opening side, and an adapter plate 230 detachable from the ventilation fan frame 220. A flange 240 perpendicular to the adapter plate 230 is disposed on a bottom of the adapter plate 230, and both the flange 210 of the ventilation fan frame and the flange 240 of the adapter plate are provided with mounting holes 241.

With the above structure, there are two methods by which the ventilation fan can be simply and conveniently mounted in a new house in which a ceiling is not mounted yet.

In the first method, firstly, the adapter plate 230 is mounted to the ventilation fan frame 220, and then the second groove 118 of the first bracket 110 is inserted into the fourth groove 128 of the second bracket 120, and the third groove 124 of the second bracket 120 is inserted into the first groove 114 of the first bracket 110 so that the first bracket 110 is engaged with the second bracket 120 to constitute the integrated bracket assembly 100.

Then, by sliding the first bracket 110 and the second bracket 120, the length of the bracket assembly 100 is adjusted such that the length of the bracket assembly 100 is equal to a distance between joists 300. Screws are passed through the mounting holes 241 in the flange 210 of the ventilation fan frame 220, and through the elongated openings 130 in the grooves. Since the grooves are each provided with the plurality of elongated openings 130, a position where the screws are passed through the bracket assembly 100 can be optionally selected so that the ventilation fan frame 220 can be mounted in any position between the first bracket 110 and the second bracket 120. Furthermore, since the screws are passed through the grooves of the first bracket 110 and the second bracket 120, firmness of the connection between the first bracket 110 and the second bracket 120 is also ensured. Flangings 1301 perpendicular to the bottom surface of the groove may also be disposed on both sides of the elongated opening 130 extending in a longitudinal direction. In this way, engagement area between the screw and the groove is increased to further ensure firmness of the connection between the first bracket 110 and the second bracket 120.

Finally, the ventilation fan frame 220 and the bracket assembly 100 which are integrally connected are fixed between the joists 300. Specifically, the connection members 113,123, and the first connection parts 1101, 1102, 1201 and 1202 of the side members 111, 112, 121 and 122 of the first bracket 110 and the second bracket 120 are fixed to the two joists 300 through screws, respectively, to complete the mounting.

In the second method, firstly, the second groove 118 of the first bracket 110 is inserted into the fourth groove 128 of the second bracket 120, and the third groove 124 of the second bracket 120 is inserted into the first groove 114 of the first bracket 110 so that the first bracket 110 is engaged with the second bracket 120 to constitute the integrated bracket assembly 100. Then, the connection members 113,123, and the first connection parts 1101, 1102, 1201 and 1202 of the side members 111, 112, 121 and 122 of the first bracket 110 and the second bracket 120 are fixed to the two joists 300 through screws, respectively, and after that, the adapter plate 230 is mounted to the bracket assembly 100. Specifically, screws are passed through the elongated openings 130 of the bracket assembly 100 and the mounting holes 241 in the flange 240 of the adapter plate 230. Since the grooves are each provided with the plurality of elongated openings 130, a position where the screws are passed through the bracket assembly 100 can be optionally selected so that the adapter plate 230 can be erected in any position between the first bracket 110 and the second bracket 120. After that, the ventilation fan frame 220 is passed through an inside of the bracket assembly 100 under the bracket assembly 100 and at the same time the ventilation fan frame 220 is engaged to the adapter plate 230 through temporary fixing structures located on the ventilation fan frame 220 and the adapter plate 230. In this case, the mounter can free his hands to pass screws through the mounting holes 241 in the flange 210 and the elongated openings 130 in the grooves, on an opposite side to the adapter plate 230, and screws through openings in a sidewall of the ventilation fan frame 220 and the adapter plate 230 to mount the ventilation fan frame 220 to the bracket assembly 100 so as to complete the mounting.

As described above, whichever method is adopted, the mounting can be carried out by a single person and the ventilation fan 200 can be mounted in any position on the bracket assembly 100.

Figure 10:
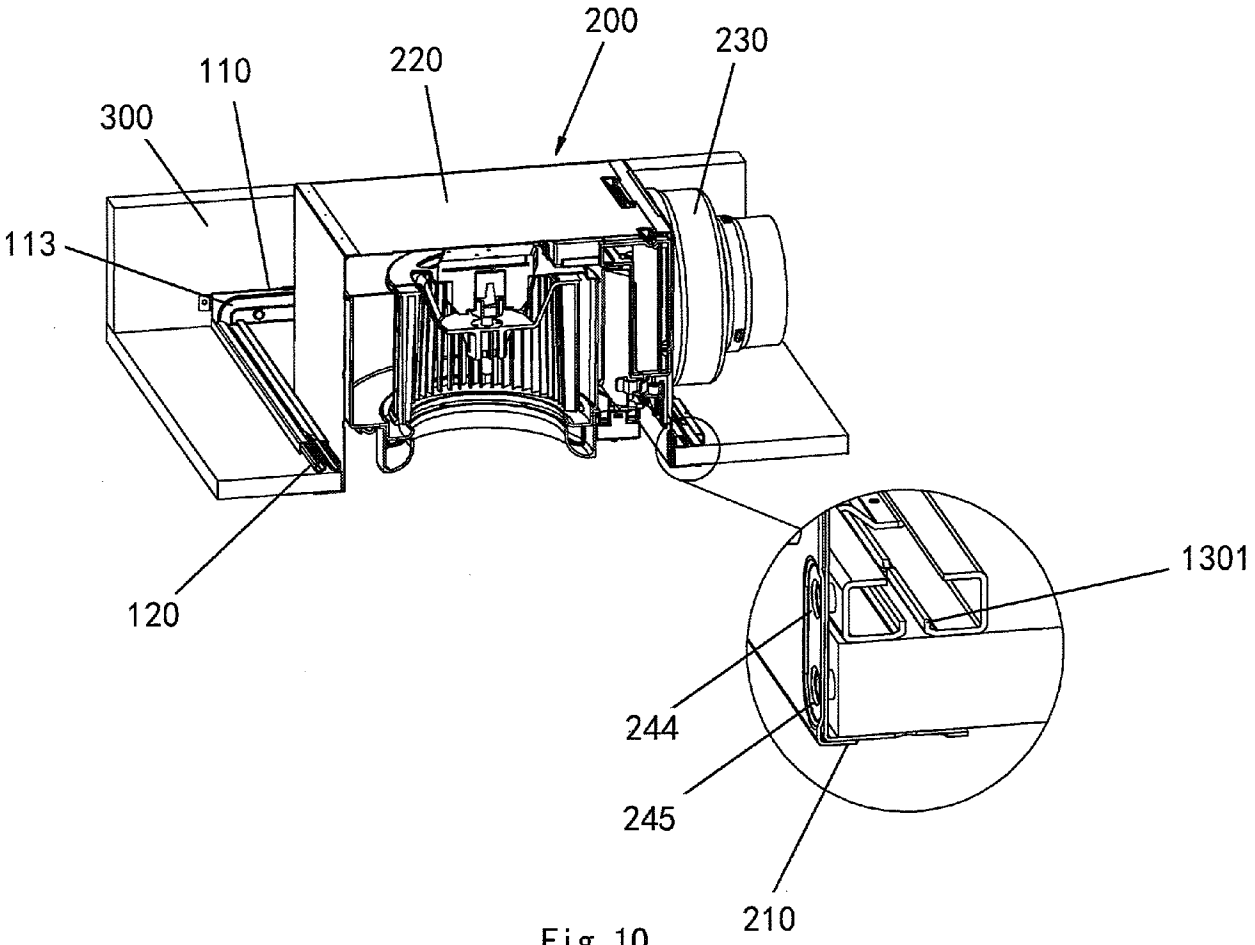
FIG. 10 is a longitudinal sectional view showing a mounting of the ventilation fan after the ceiling has been mounted, according to an embodiment of the present invention.

FIG. 10 is a longitudinal sectional view showing a mounting of the ventilation fan after the ceiling has been mounted, according to an embodiment of the present invention. As shown in FIGS. 2-3B and 10, if the ceiling has only one opening having the same size as the ventilation fan frame 220, i.e., if a user wants to replace the ventilation fan once the ceiling and the ventilation fan have been mounted, when mounting the new ventilation fan 200 to the joists 300, firstly, the second groove 118 of the first bracket 110 is inserted into the fourth groove 128 of the second bracket 120, and the third groove 124 of the second bracket 120 is inserted into the first groove 114 of the first bracket 110 so that the first bracket 110 is engaged with the second bracket 120 to constitute the integrated bracket assembly 100. Then, the first bracket 110 and the second bracket 120 are pulled towards each other to shorten the length of the bracket assembly 100. After that, the bracket assembly 100 is passed through the ceiling opening and placed over the ceiling (a back surface of the ceiling) and then the first bracket 110 and the second bracket 120 are pulled away from each other. The connection members 113 and 123 of the first bracket 110 and the second bracket 120 are fixed to the joists 300 and next the adapter plate 230 is mounted to the bracket assembly 100. Specifically, the flange 240 of the adapter 230 abuts against a lower surface of the ceiling, and screws are passed through the elongated openings 130 of the bracket assembly 100, the ceiling, and the mounting holes 241 in the flange 240 of the adapter plate 230, so that the adapter plate 230 can be erected in any position between the first bracket 110 and the second bracket 120. After that, the ventilation fan frame 220 is passed through an inside of the bracket assembly 100 under the bracket assembly 100 and at the same time the ventilation fan frame 220 is engaged to the adapter plate 230 through temporary fixing structures located on the ventilation fan frame 220 and the adapter plate 230. In this case, the mounter can free his hands to pass screws through the mounting holes 241 in the flange 210 and the elongated openings 130 in the first groove 114 and the second groove 118, on an opposite side to the adapter plate 230, and screws through openings in a sidewall of the ventilation fan frame 220 and the adapter plate 230 to mount the ventilation fan frame 220 to the bracket assembly 100 so as to complete the mounting.

As described above, even if the ceiling has only one opening having the same size as a ventilation fan frame, one person can simply complete the mounting of the ventilation fan with the brackets according to the embodiments of the present invention.

It is not necessary to detach the snail shell during the mounting and the bracket assembly includes only the first bracket and the second bracket so that the cost is lower, compared with prior art.

In addition, as shown in FIGS. 6-7, a hook sheet 290 extending upwards towards the ventilation fan frame 220 side is disposed on a back surface of the adapter plate 230 of the ventilation fan 200, an elastic sheet 250 is disposed on a side surface of the ventilation fan frame 220 connecting to the adapter plate 230, and an engagement hole 260 is disposed under the elastic sheet 250. The back surface of the adapter plate 230 means a surface of the adapter plate 230 facing the ventilation fan frame 220.

After the bracket assembly 100 is fixed between the joists 300 and the adapter plate 230 is mounted to the bracket assembly 100, when the ventilation fan frame 220 is engaged upwards to the adapter plate 230 from below the bracket assembly 100, the elastic sheet 250 on the ventilation fan frame 220 is pressed, by the hook sheet 290 on the back surface of the adapter plate 230, to be deformed towards an inside of the ventilation fan frame 220 until the hook sheet 290 enters the engagement hole 260 disposed under the elastic sheet 250. The elastic sheet 250 is no longer pressed by the hook sheet 290, is restored to its original position, and abuts against the hook sheet 290. As a result, the temporary connection between the ventilation fan frame 220 and the adapter plate 230 is achieved. In this case, the user can release the ventilation fan frame 220 from his hand and pass screws through the mounting holes 241 in the flange 210 and the elongated openings 130 in the grooves, on an opposite side to the adapter plate 230, and screws through openings 245 and 243 in a sidewall of the ventilation fan frame 220 and the adapter plate 230 to mount the ventilation fan frame 220 to the bracket assembly 100.

In addition, as shown in FIGS. 6-9, an upper first opening 242 and a lower second opening 243 are disposed in the adapter plate 230 near the flange 240 of the adapter plate 230, and an upper third opening 244 and a lower fourth opening 245 are disposed in the sidewall of the ventilation fan frame 220 attaching to the adapter plate 230.

When the ventilation fan 200 is mounted in a new house in which the ceiling is not mounted yet, the flange 240 of the adapter plate 230 is mounted to abut against the bracket assembly 100, and the flange 210 of the ventilation fan frame 220 is also mounted to abut against the flange 240 of the adapter plate 230. Therefore, the screws can be passed through the upper third opening 244 in the ventilation fan frame 220 and the upper first opening 242 in the adapter plate 230 to connect the ventilation fan frame 220 and the adapter plate 230 to each other.

When a user mounts the ventilation fan 200 after the ceiling has been mounted, the bracket assembly 100 is mounted to abut against the upper surface of the ceiling, the flange 240 of the adapter plate 230 is mounted to abut against the lower surface of the ceiling, and the flange 210 of the ventilation fan frame 220 is mounted to abut against the flange 240 of the adapter plate 230. In other words, the bracket assembly 100 is separated from the adapter plate 230 and the ventilation fan frame 220 by the ceiling. Depending upon the thickness of the ceiling, the bracket assembly 100 may interfere with the first opening 242 and the third opening 244. In this case, the screws can be passed through the lower third opening 244 in the ventilation fan frame 220 and the lower fourth opening 245 in the adapter plate 230 to connect the ventilation fan frame 220 and the adapter plate 230 to each other. Although the ceiling interferes with the third opening 244 and the fourth opening 245, the screws can pass through the material of the ceiling so that the ceiling will not impede connection between the adapter plate 230 and the ventilation fan frame 220.

Furthermore, as shown in FIGS. 5A and 5B, a longitudinal positioning groove 2301 of the adapter plate 230 is formed in such a way that two side edges of the adapter plate 230 which extend in a width direction are bent towards the ventilation fan frame 220 side and then bend towards an inside of the adapter plate 230, and a positioning sheet 2201 is formed in such a way that two side edges of a side surface, which is connected to the adapter plate 230, of the ventilation fan frame 220 are respectively bent towards an outside of the ventilation fan frame 220 and then bent in an opposite direction to the adapter plate 230. The two positioning sheets 2201 are disposed. When a user first mounts the adapter plate 230 to the bracket assembly 100 before mounting the ventilation fan frame 220, after screws are passed through the elongated openings 130 of the bracket assembly 100 and the mounting holes 241 in the flange 240 of the adapter plate 230, an upper portion of the adapter plate 230 is probably inclined towards a pipe connected to the adapter due to weights of the adapter itself and the pipe. Therefore, there will be a gap between the adapter plate 230 and the ventilation fan frame 220 to adversely affect airtightness. By disposing the positioning groove 2301 and the positioning sheet 2201, when a user engages the ventilation fan frame 220 to the adapter plate 230 from below the bracket assembly 100, he inserts the positioning sheet 2201 of the ventilation fan frame 220 into the positioning groove 2301 of the adapter plate 230 so that the positioning sheet 2201 will lock the positioning groove 2301. In other words, the adapter plate 230 is locked by the ventilation fan frame 220 so that the adapter plate 230 will not be inclined towards the pipe side due to the weights of the adapter and the pipe. Therefore, the ventilation fan frame 220 and the adapter plate 230 are always connected to each other tightly, that is, the airtightness is improved.

Figure 11:
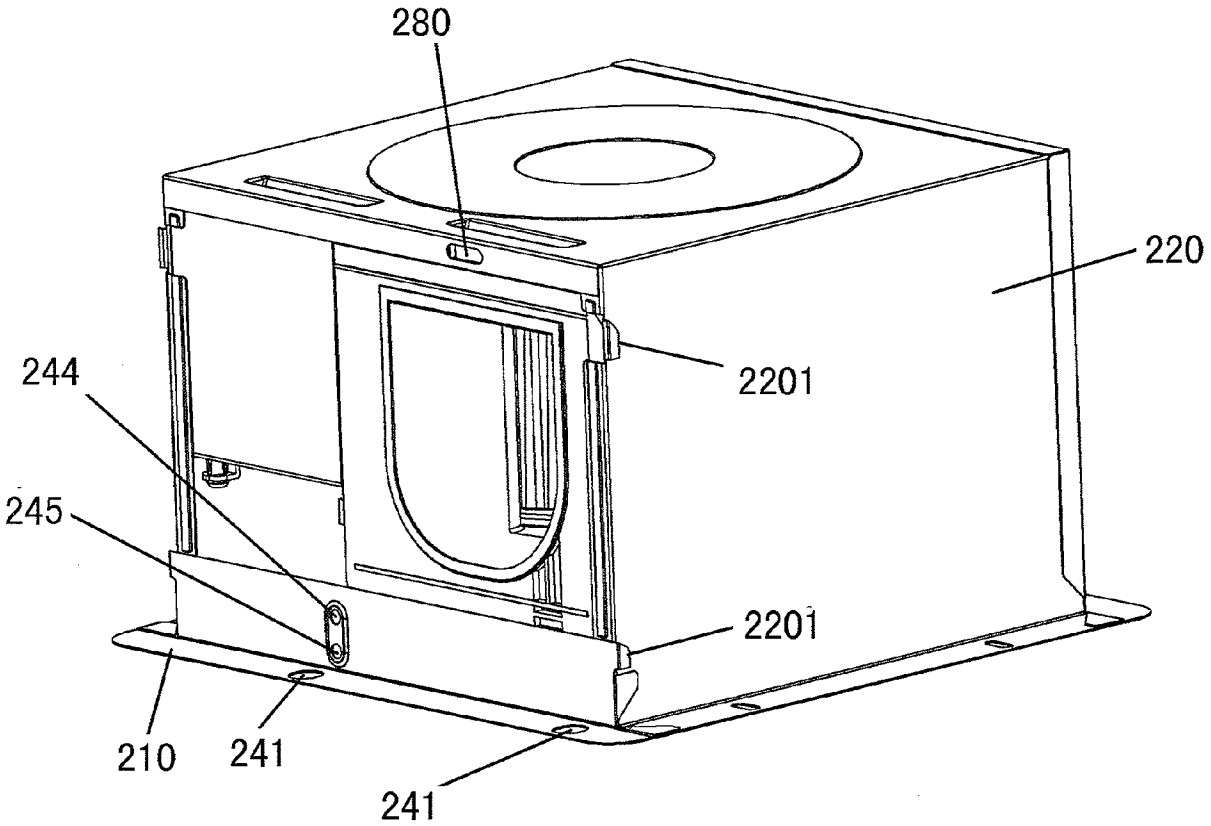
FIG. 11 is a schematic view of the ventilation fan frame which is provided with another temporary fixing structure, according to an embodiment of the present invention.
Figure 12:
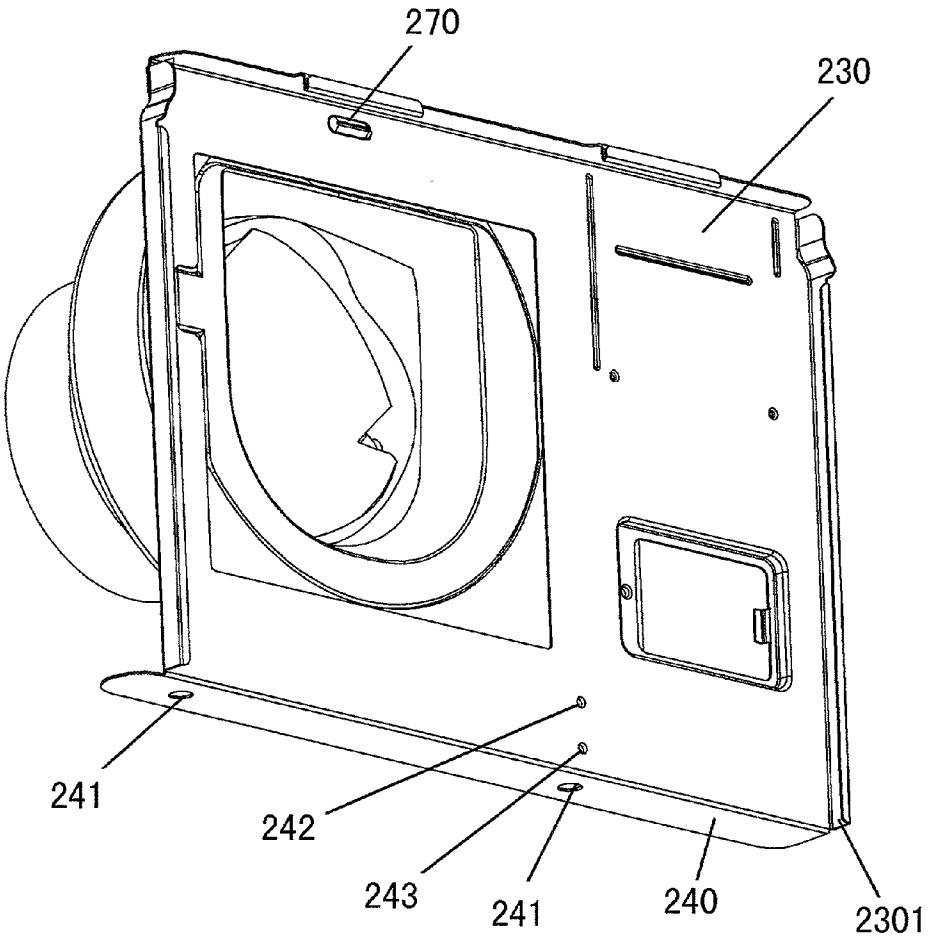
FIG. 12 is a schematic view of the adapter plate which is provided with another temporary fixing structure, according to an embodiment of the present invention.

FIG. 11 is a schematic view of the ventilation fan frame which is provided with another temporary fixing structure, according to an embodiment of the present invention; and FIG. 12 is schematic view of the adapter plate which is provided with another temporary fixing structure, according to an embodiment of the present invention. As shown in FIGS. 11 and 12, according to the embodiment of the present invention, there is also provided a temporary fixing structure for temporarily fixing the ventilation fan frame 220 to the adapter plate 230. A protrusion 270 protruding towards the ventilation fan frame 220 side is disposed on the back surface of the adapter plate 230 near a top of the adapter plate 230, and an opening 280 into which the protrusion 270 is engaged is disposed on a side surface of the ventilation fan frame 220 attaching to the adapter plate 230.

After the bracket assembly 100 is fixed between the joists 300 and the adapter plate 230 is mounted to the bracket assembly 100, when the ventilation fan frame 220 is engaged upwards to the adapter plate 230 from below the bracket assembly 100, the ventilation fan frame 220 is moved upwards to the protrusion 270 and moved slightly towards an opposite side to the adapter plate 230, and then the protrusion 270 is engaged into the opening 280. As a result, the temporary connection between the ventilation fan frame 220 and the adapter plate 230 is achieved. In this case, the user can release the ventilation fan frame 220 from his hand and pass screws through the mounting holes 241 in the flange 210 and the elongated openings 130 in the grooves, on an opposite side to the adapter plate 230, and screws through the openings 241 in the sidewall of the ventilation fan frame 220 and the adapter plate 230 to mount the ventilation fan frame 220 to the bracket assembly 100.

The protrusion 270 is disposed on the back surface of the adapter plate 230 near the top of the adapter plate 230. Therefore, during upward pushing of the ventilation fan frame 220 to the adapter plate 230, the protrusion 270 will not press against the ventilation fan frame 220 before the ventilation fan frame 220 comes into contact with the protrusion 270. As a result, the ventilation fan frame 220 can be pushed onto the adapter plate 230 more easily and more smoothly.

Figure 13A:
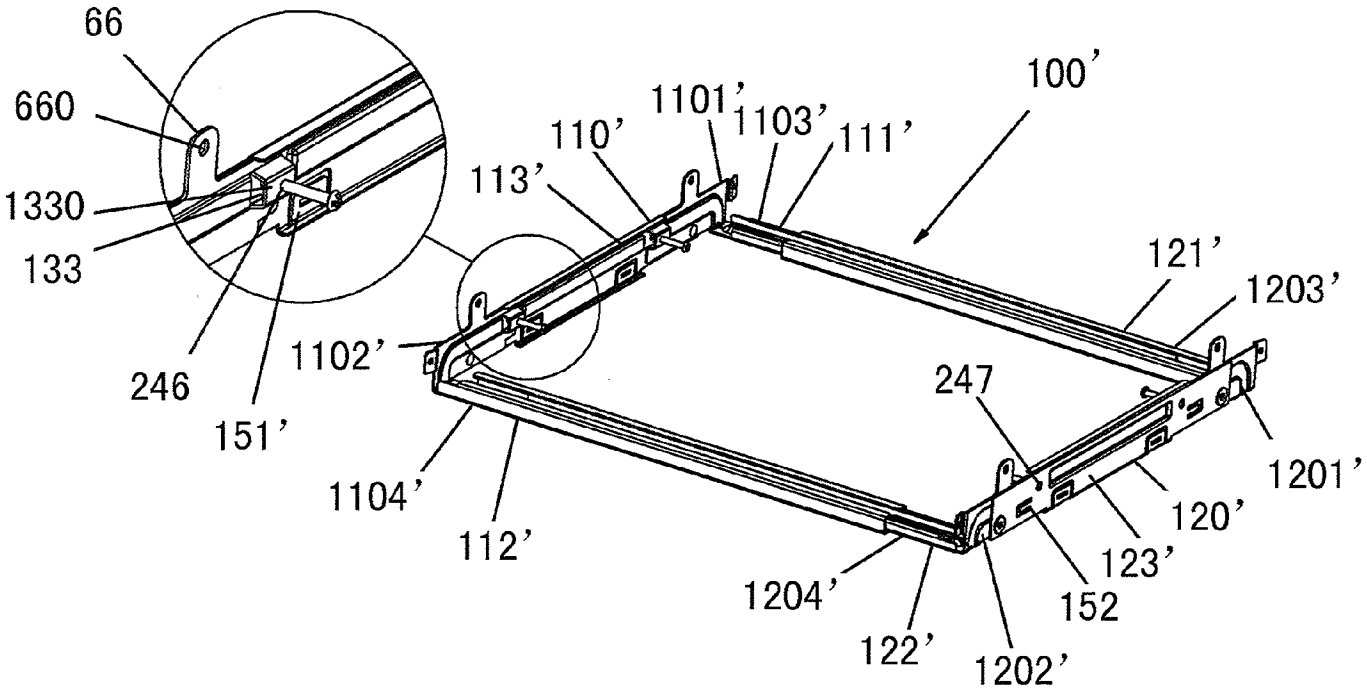
FIGS. 13A and 13B are schematic views of the bracket assembly according to a second embodiment of the present invention.
Figure 13B:
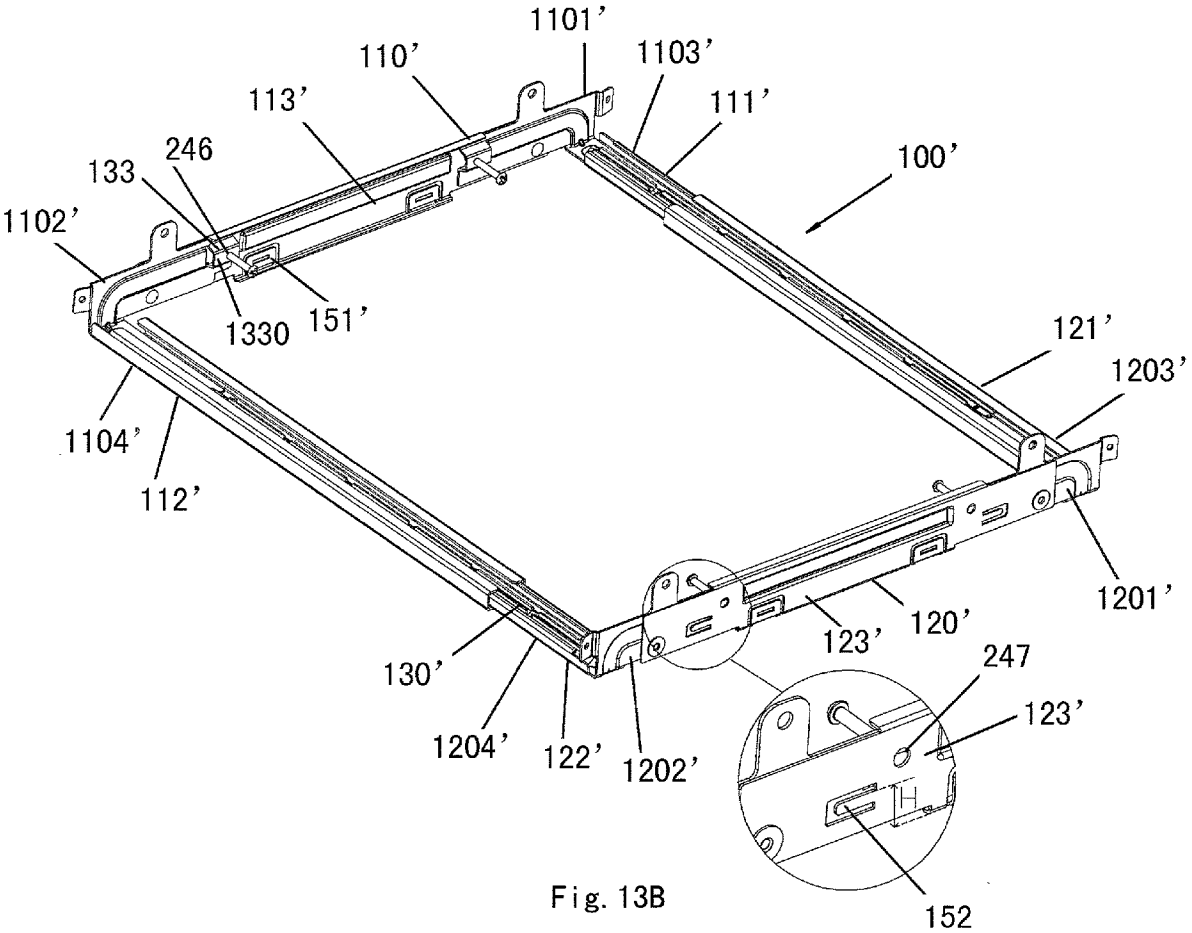

FIGS. 13A and 13B are schematic views of the bracket assembly according to a second embodiment of the present invention. As shown in FIGS. 13A and 13B, as the bracket assembly 100 of the first embodiment, the side members 111' and 112' of the first bracket 110' of the bracket assembly 100' of the second embodiment comprise first connection parts 1101' and 1102' connected to the connection member 113' and second connection parts 1103' and 1104' connected to the side members 121' and 122' of the second bracket 120', the first connection part 1101' and the second connection part 1103' are formed in an L shape, and the first connection part 1102' and the second connection part 1104' are formed in an L shape.

The side members 121' and 122' of the second bracket 120' comprise first connection parts 1201' and 1202' connected to the connection member 123' and second connection parts 1203' and 1204' connected to the side members 111' and 112' of the first bracket 110', the first connection part 1201' and the second connection part 1203' are formed in an L shape, and the first connection part 1202' and the second connection part 1204' are formed in an L shape. The lower edges of the connection members 113' and 123' of the first and second brackets 110' and 120' are provided with first stop sheets 151', and the first stop sheets 151' are bendable towards an outside of the bracket assembly 100'. In other words, the first stop sheets 151' protrude towards the outside of the bracket assembly 100'.

Figure 14:
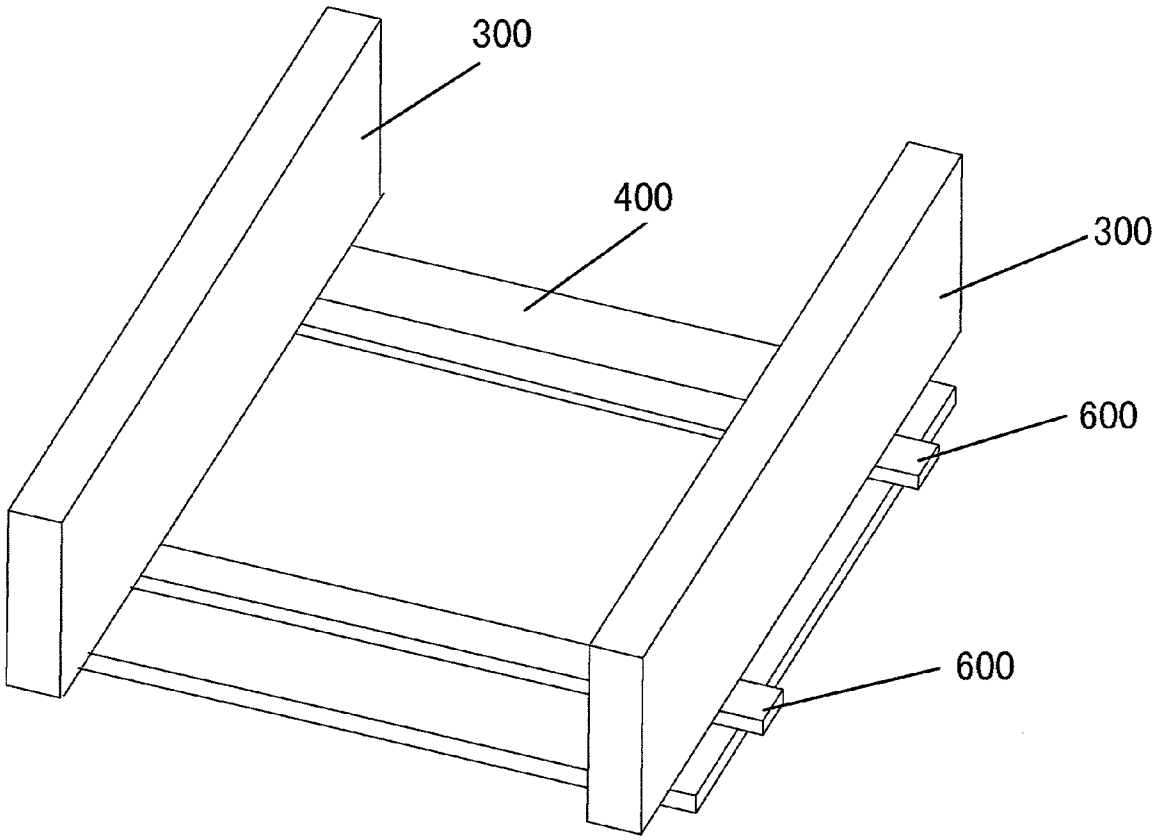
FIG. 14 is schematic view showing that fixing wood strips are mounted under joists.

FIG. 14 is schematic view showing that fixing wood strips are mounted under joists. As shown in FIG. 14, in some regions, fixing wood strips 600 perpendicular to the joists 300 will be additionally disposed under the joists 300, and the fixing wood strip 600 are fixed to the joists 300 to enhance the stability of the joists 300. However, the joists 300 are separated from the ceiling 400 by the fixing wood strips 600. If the ventilation fan 200 is mounted in a new house in which the ceiling 400 is not mounted yet, by the bracket assembly 100 of the first embodiment, the flange 210 of the ventilation fan frame 220 and the flange 240 of the adapter plate 230 are separated from the ceiling 400 by a distance equal to a height of the fixing wood strips 600 since, as described above, the lower edge of the bracket assembly 100 is flush with the bottom surfaces of the joists 300 and the flange 210 of the ventilation fan frame 220 and the flange 240 of the adapter plate 230 abut against the bracket assembly 100.

If the ventilation fan 200 is mounted by the bracket assembly 100 of the first embodiment after the ceiling 400 has been mounted, the flange 210 of the ventilation fan frame 220 and the flange 240 of the adapter plate 230 are separated from the bracket assembly 100 by the fixing wood strips 600 and the ceiling 400 since the lower edge of the bracket assembly 100 is flush with the bottom surfaces of the joists 300 and the flange 210 of the ventilation fan frame 220 and the flange 240 of the adapter plate 230 abut against the lower surface of the ceiling 400. As a result, the ventilation fan cannot be mounted.

Furthermore, as shown in FIGS. 13A and 13B, in order to satisfy actual requirements of the abovementioned regions, on the basis of the structure of the bracket assembly 100 of the first embodiment, extension sheets 66 extend upwards from tops of the first connection parts 1101', 1102', 1201', and 1202', of the first bracket 110' and the second bracket 120' of the bracket assembly 100' of the second embodiment. The extension sheets 66 are provided with openings 660, and the connection members 113' and 123' of the first and second brackets 110' and 120' are provided with second stop sheets 152 bendable towards an outside of the bracket assembly 100', and a distance H between an upper edge of the second stop sheet 152 and the lower edges of the connection members 113' and 123' is equal to a height of the fixing wood strip 600.

Figure 15:
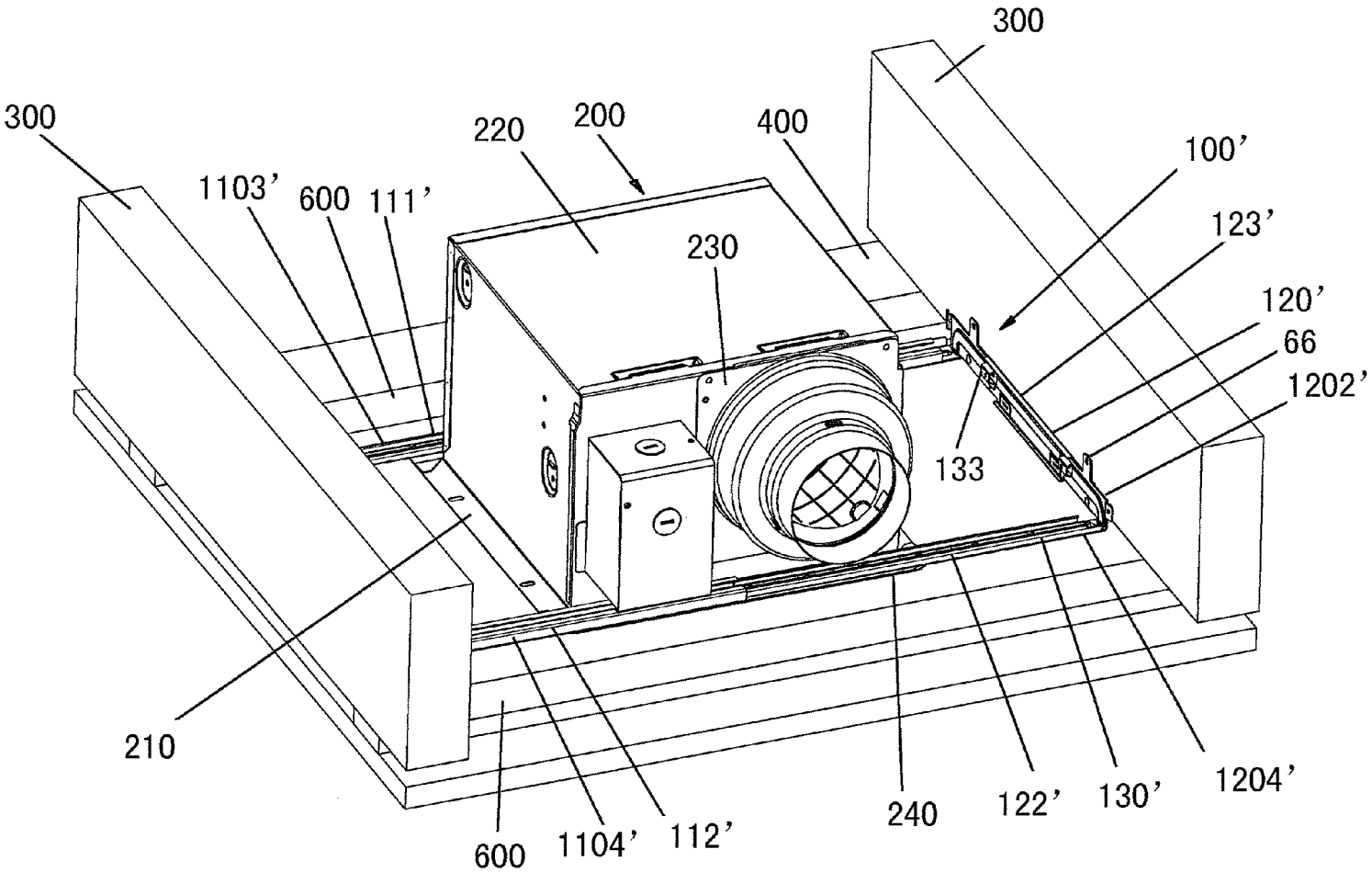
FIG. 15 is a schematic view showing that the ventilation fan is mounted in a new house in which the fixing wood strips are mounted and the ceiling is not mounted yet, by means of the bracket assembly according to the second embodiment of the present invention.
Figure 16:
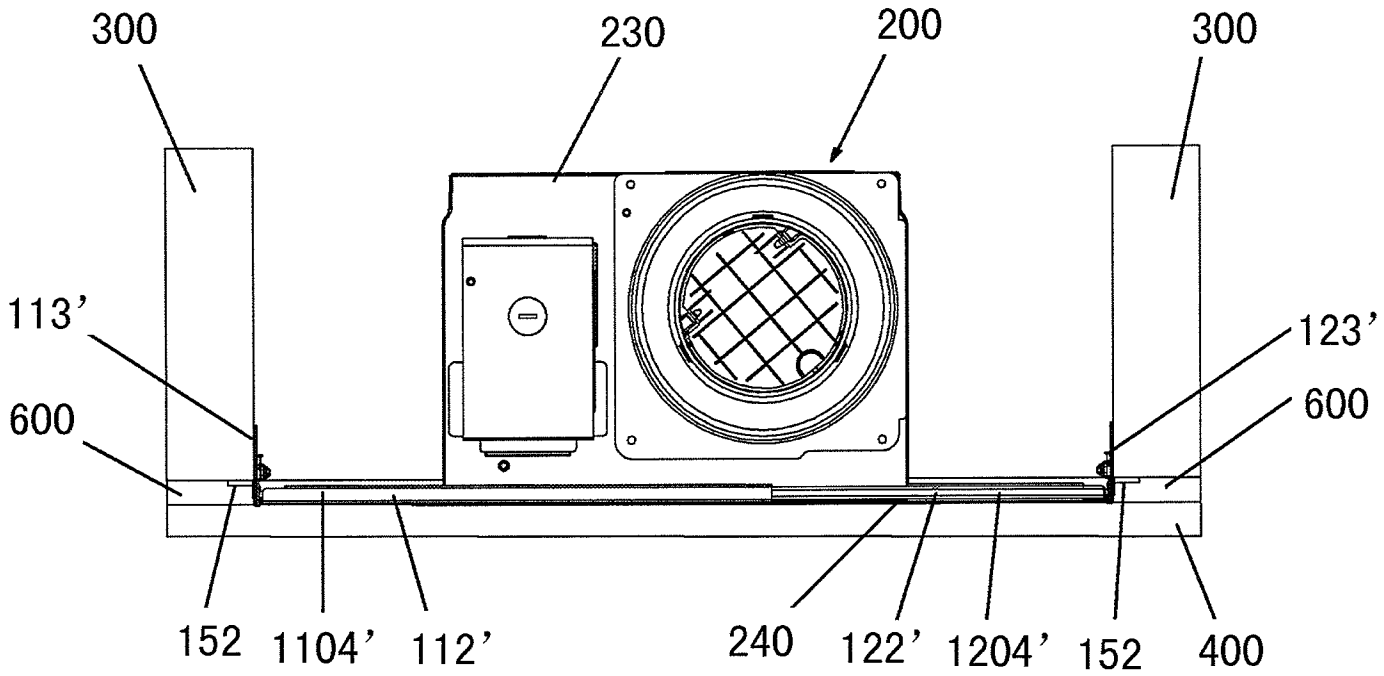
FIG. 16 is a schematic view showing, at another angle, that the ventilation fan is mounted in the new house in which the fixing wood strips are mounted and the ceiling is not mounted yet, by means of the bracket assembly according to the second embodiment of the present invention.

FIG. 15 is a schematic view showing that the ventilation fan is mounted in a new house in which the fixing wood strips are mounted and the ceiling is not mounted yet, by means of the bracket assembly according to the second embodiment of the present invention; and FIG. 16 is a schematic view showing, at another angle, that the ventilation fan is mounted in the new house in which the fixing wood strips are mounted and the ceiling is not mounted yet, by means of the bracket assembly according to the second embodiment of the present invention. In order to facilitate the showing of the second stop sheet 152, the front fixing wood strip is omitted in FIG. 16.

As shown in the figures, when the ventilation fan 200 is mounted in the new house in which the ceiling is not mounted yet, by means of the bracket assembly 100' according to the second embodiment, the second stop sheets 152 are bent towards the outside of the bracket assembly 100' in advance before the bracket assembly 100' is mounted. When the bracket assembly 100' is mounted to the joists 300, the bent second stop sheets 152 can abut against the lower surfaces of the joists 300. Since the distance H between the upper edge of the second stop sheet 152 and the lower edges of the connection members 113' and 123' is equal to the height of the fixing wood strip 600, a distance by which the bracket assembly 100' is displaced downwards is equal to the height of the fixing wood strip 600 when the second stop sheets 152 abut against the lower surfaces of the joists 300. In this way, the lower edge of the bracket assembly 100' can be easily flushed with the bottoms of the fixing wood strips 600 so as to position the bracket assembly 100' in the vertical direction.

The extension sheets 66 extend upwards from the tops of the first connection parts 1101', 1102', 1201', and 1202', of the first bracket 110' and the second bracket 120' to the joists 300.

Therefore, even if the bracket assembly 100' is displaced downwards to the fixing wood strips 600, the screws can be passed through the openings 660 of the extension sheets 66 and the joists 300 to fix the bracket assembly 100' to the joists 300. Since the bracket assembly 100' is displaced downwards to the fixing wood strips 600, there is no gap between the ventilation fan 200 mounted to the bracket assembly 100' and the ceiling 400.

Figure 17:
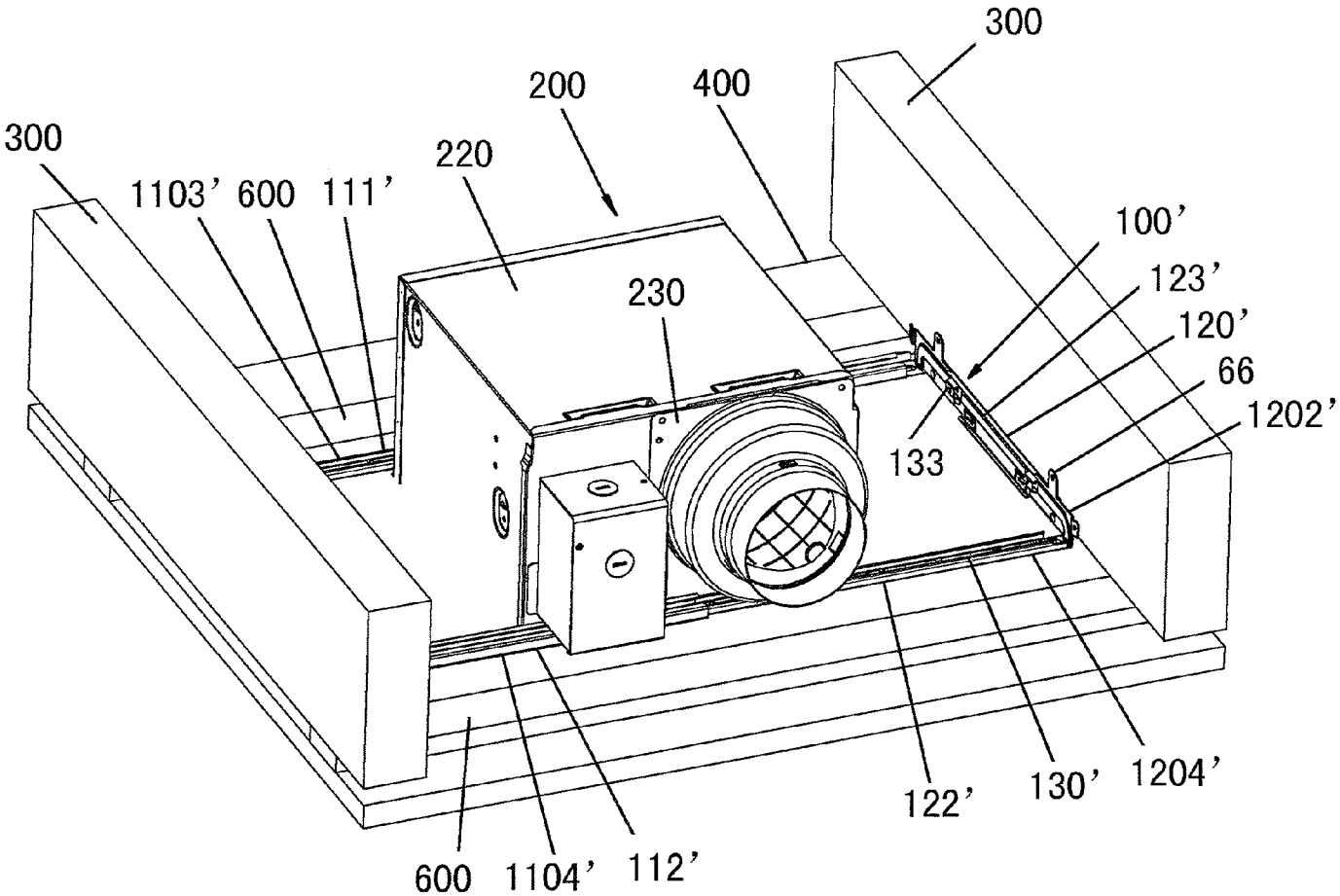
FIG. 17 is a schematic view showing that after the ceiling has been mounted, the ventilation fan is mounted to the joists to which the fixing wood strips are mounted, by means of the bracket assembly according to the second embodiment of the present invention.
Figure 18:
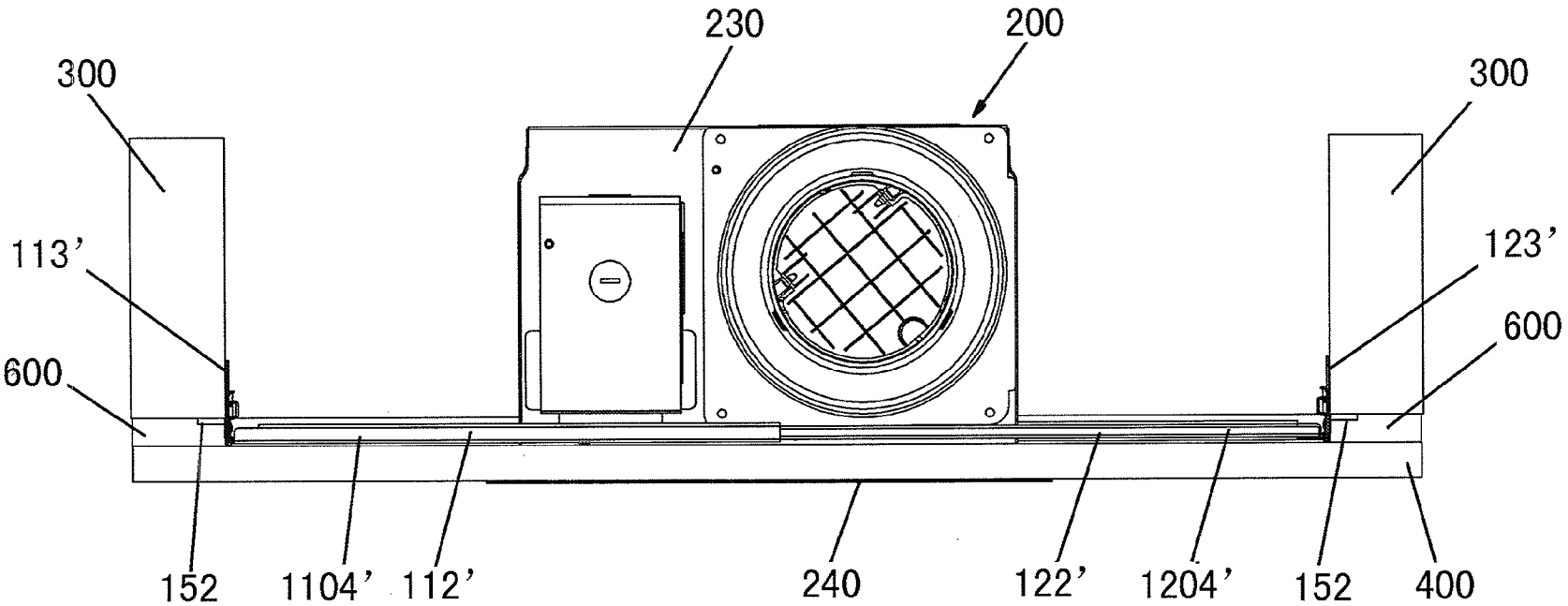
FIG. 18 is a schematic view showing, at another angle, that after the ceiling has been mounted, the ventilation fan is mounted to the joists to which the fixing wood strips are mounted, by means of the bracket assembly according to the second embodiment of the present invention.

FIG. 17 is a schematic view showing that after the ceiling has been mounted, the ventilation fan is mounted to the joists to which the fixing wood strips are mounted, by means of the bracket assembly according to the second embodiment of the present invention; and FIG. 18 is a schematic view showing, at another angle, that after the ceiling has been mounted, the ventilation fan is mounted to the joists to which the fixing wood strips are mounted, by means of the bracket assembly according to the second embodiment of the present invention. In order to facilitate the showing of the second stop sheet 152, the front fixing wood strip is omitted in FIG. 18.

As shown in the figures, if the ceiling 400 has only one opening having the same size as the ventilation fan frame 220, i.e., if a user wants to replace the ventilation fan 200 once the ceiling 400 and the ventilation fan 200 have been mounted, the second stop sheets 152 are bent towards the outside of the bracket assembly 100' in advance before the bracket assembly 100' is mounted. In other words, the second stop sheets 152 protrude towards the outside of the bracket assembly 100'. When the bracket assembly 100' is mounted to the joists 300, the bent second stop sheets 152 can abut against the lower surfaces of the joists 300. Since the distance H between the upper edge of the second stop sheet 152 and the lower edges of the connection members 113' and 123' is equal to the height of the fixing wood strip 600, a distance by which the bracket assembly 100' is displaced downwards is equal to the height of the fixing wood strip 600 when the second stop sheets 152 abut against the lower surfaces of the joists 300. In this way, the lower edge of the bracket assembly 100' can be easily flushed with the bottoms of the fixing wood strips 600 so as to position the bracket assembly 100' in the vertical direction.

The extension sheets 66 extend upwards from the tops of the first connection parts 1101', 1102', 1201', and 1202', of the first bracket 110' and the second bracket 120' to the joists 300. Therefore, even if the bracket assembly 100' is displaced downwards to the fixing wood strips 600, the screws can be passed through the openings 660 of the extension sheets 66 and the joists 300 to fix the bracket assembly 100' to the joists 300. Since the bracket assembly 100' is displaced downwards to the fixing wood strips 600, the lower edge of the bracket assembly 100' is flush with the bottoms of the fixing wood strips 600, and the flange 240 of the adapter plate 230 and the flange 210 of the ventilation fan frame 220 abut against the lower surface of the ceiling 400, the flange 240 of the adapter plate 230 and the flange 210 of the ventilation fan frame 220 are separated from the bracket assembly 100' by only the ceiling 400. Screws can be passed through the ceiling 400, the elongated openings 130' of the bracket assembly 100' and the mounting holes 241 in the flange 240 of the adapter plate 230 and the flange 210 of the ventilation fan frame 220 to mount the ventilation fan 200 to the bracket assembly 100'.

The first connection parts of the side members of the first and second brackets of either of the bracket assembly 100 of the first embodiment and the bracket assembly 100' of the second embodiment may be provided with fifth openings located on an inside of the bracket assembly and through which screws passes, and sixth openings are disposed in positions corresponding to the fifth openings in the connection members of the first and second brackets. The first connection parts of the side members of the first and second brackets are provided with screw engaging parts protruding towards an inside of the bracket assembly, and the fifth openings are disposed in the surfaces, opposite to the ventilation fan, of the screw engaging parts.

As shown in FIGS. 13A and 13B, the second embodiment is taken as an example. The first connection parts 1101', 1102', 1201', and 1202' of the side members 111', 112', 121', and 122' of the first and second brackets 110' and 120' of the bracket assembly 100' are provided with fifth openings 246 located on an inside of the bracket assembly 100' and through which screws passes, and sixth openings 247 are disposed in positions corresponding to the fifth openings 246 in the connection members 113' and 123' of the first and second brackets 110' and 120'. The first connection parts 1101', 1102', 1201', and 1202' of the side members 111', 112', 121', and 122' of the first and second brackets 110' and 120' are provided with screw engaging parts 133 protruding towards an inside of the bracket assembly 100', and the fifth openings 246 are disposed in the surfaces 1330, opposite to the ventilation fan, of the screw engaging parts 133.

When the ceiling 400 has only one opening having the same size as the ventilation fan frame 220 and there is no fixing wood strip 600 disposed between the joists 300 and the ceiling 400, a user can fix the bracket assembly 100' to the joists 300 from the inside of the bracket assembly 100'. Specifically, since the fifth openings 246 are located in the inside of the bracket assembly 100' and the sixth openings 247 of the connection members 113' and 123' are located in corresponding positions to the fifth openings 246, the screws can be passed through the fifth openings 246, the sixth openings 247 and the joists 300 from the inside of the bracket assembly 100' to fix the bracket assembly 100' to the joists 300.

In addition, since the first connection parts 1101', 1102', 1201', and 1202' are provided with the screw engaging parts 133 protruding towards an inside of the bracket assembly 100', and the fifth openings 246 are disposed in the surfaces 1330, opposite to the ventilation fan 200, of the screw engaging parts 133, the screws can be engaged to the screw engaging parts 133 in advance before the bracket assembly 100' is mounted to the joists 300. Since the screw engaging parts 133 protrude towards the inside of the bracket assembly 100', the screws can be temporarily placed in a space between the fifth openings 246 of the screw engaging parts 133 and the first connection parts 1101', 1102', 1201', and 1202'. In other words, the screws can be engaged to the screw engaging parts 133. After the user places the bracket assembly 100' between the joists 300, he can directly tighten the screws with a tool without holding the screws with his hand since the screws have been engaged to the screw engaging parts 133 in advance. In this way, the user can tighten the screws with the tool while he brackets the bracket assembly 100'. Therefore, one person can complete the operation. Of course, flangings (not shown) protruding towards the inside of the bracket assembly 100' may also be disposed on edges of the fifth opening 246 so that the screws can be engaged firmly to the fifth openings.

In addition, the connection members 113 and 113' of the first brackets 110 and 110' and the connection members 123 and 123' of the second brackets 120 and 120' of the first and second embodiments of the present invention may be formed of resin material. The weight of the bracket assembly 100 and 100' can be reduced by using the resin material. As a result, the mounter's burden of physical force is decreased and constructability is improved. If nonflammable material must be used, nonflammable resin can be used.

The invention claimed is:

1. A ventilation fan mounting structure, comprising:

a bracket assembly, which is to be mounted to two opposite side flanges of a ventilation fan and includes a first bracket and a second bracket each formed in a U shape, wherein each of the first bracket and the second bracket includes two side members and a connection member connecting the two side members, wherein the connection members and the side members of the first and second brackets are connected to each other by shafts, the side members are rotatable around the shafts, and a position-limit portion for limiting a rotation range of the side member is disposed to the connection member.

2. The ventilation fan mounting structure of claim 1, wherein: the side member of either of the first and second brackets comprises a first connection part connected to the connection member and a second connection part connected to the side member of the other of the first and second brackets, and the first connection part and the second connection part are formed in an L shape.

3. The ventilation fan mounting structure of claim 2, wherein:

rivets serve as the shafts, the connection members and the first connection parts of the side members of the first and second brackets are connected with each other through the rivets, and the side members are rotatable around the rivets.

4. The ventilation fan mounting structure of claim 1, wherein: the position-limit portion is a bent sheet bent from an upper edge of the connection member towards an inside of the bracket assembly.

5. The ventilation fan mounting structure of claim 4, wherein: the bent sheet is perpendicular to the connection member.

6. The ventilation fan mounting structure of claim 1, wherein: the connection member is integrally formed with an elongated protrusion.

7. The ventilation fan mounting structure of claim 2, wherein: the lower edges of the connection members of the first and second brackets are provided with first stop sheets, and the first stop sheets are bendable towards an outside of the bracket assembly, and are flush with the lower edges of the connection members after being bent.

8. The ventilation fan mounting structure of claim 2, wherein: the second connection parts of the two side members of each of the first and second brackets are each formed in a C-shaped open groove in such a way that left and right edges extending in a vertical direction are bent into a horizontal direction so as to form two horizontal edge surfaces, and the C-shaped open groove is provided with a plurality of elongated openings; and, when the first bracket and the second bracket are integrally engaged to constitute the bracket assembly, the two edges surfaces, two side surfaces, and a bottom surface of the groove of either of the first and second brackets of the bracket assembly can be surrounded by the two edges surfaces, two side surfaces, and a bottom surface of the groove of the other of the first and second brackets and are slidably mounted within the groove of the other of the brackets.

9. The ventilation fan mounting structure of claim 8, wherein: flangings perpendicular to the bottom surface of the groove are disposed on both sides of the elongated opening which extend in a longitudinal direction.

10. The ventilation fan mounting structure of claim 1, wherein: the first bracket and the second bracket have the same structure.

11. The ventilation fan mounting structure of claim 1, wherein: the bracket assembly is configured to be mounted to the ventilation fan; the ventilation fan comprises a ventilation fan frame formed with a flange on indoor opening side thereof, and an adapter plate detachable from the ventilation fan frame; and, a flange perpendicular to the adapter plate is disposed on a bottom of the adapter plate, and both the flange of the ventilation fan frame and the flange of the adapter plate are provided with mounting holes.

12. The ventilation fan mounting structure of claim 11, wherein: a hook sheet extending upwards towards the ventilation fan frame side is disposed on a back surface of the adapter plate, an elastic sheet is disposed on a side surface of the ventilation fan frame attaching to the adapter plate, and an engagement hole is disposed under the elastic sheet.

13. The ventilation fan mounting structure of claim 11, wherein: a protrusion protruding towards the ventilation fan frame side is disposed on the adapter plate of the ventilation fan near a top of the adapter plate, and an opening into which the protrusion is engaged is disposed on a side surface of the ventilation fan frame attaching to the adapter plate.

14. The ventilation fan mounting structure of claim 11, wherein: a positioning groove of the adapter plate is formed in such a way that two side edges of the adapter plate extending in a width direction are bent towards the ventilation fan frame side and then bend towards an inside of the adapter plate, and a positioning sheet is formed in such a way that two side edges of a side surface, which is connected to the adapter plate, of the ventilation fan frame are bent towards an outside of the ventilation fan frame and then bent in an opposite direction to the adapter plate.

15. The ventilation fan mounting structure of claim 14, wherein: the number of the positioning sheets is two or more.

16. The ventilation fan mounting structure of claim 11, wherein: an upper first opening and a lower second opening are disposed in the adapter plate near the flange of the adapter plate, and an upper third opening and a lower fourth opening are disposed in a sidewall of the ventilation fan frame attaching to the adapter plate.

17. The ventilation fan mounting structure of claim 2, wherein: extension sheets extend upwards from tops of the first connection parts of the first and second brackets.

18. The ventilation fan mounting structure of claim 17, wherein: the extension sheets are provided with openings.

19. The ventilation fan mounting structure of claim 17, wherein: the lower edges of the connection members of the first and second brackets are provided with first stop sheets, and the first stop sheets are bendable towards an outside of the bracket assembly, and are flush with the lower edges of the connection members after being bent.

20. The ventilation fan mounting structure of claim 17, wherein:

the ventilation fan mounting structure is fixed between a pair of joists, and fixing wood strips perpendicular to the joists are disposed under the joists and are fixed to the joists; and the connection members of the first and second brackets are provided with second stop sheets bendable towards an outside of the bracket assembly, and a distance between an upper edge of the second stop sheet and the lower edge of the connection member is equal to a height of the fixing wood strip.

21. The ventilation fan mounting structure of claim 2, wherein: fifth openings through which screws passes are disposed in the first connection parts of the side members of the first and second brackets, on an inside of the bracket assembly.

22. The ventilation fan mounting structure of claim 21, wherein: sixth openings are disposed in positions corresponding to the fifth openings in the connection members of the first and second brackets.

23. The ventilation fan mounting structure of claim 21, wherein: the first connection parts of the side members of the first and second brackets are provided with screw engaging parts protruding towards an inside of the bracket assembly, and the fifth openings are disposed in the surfaces, opposite to the ventilation fan, of the screw engaging parts.

24. The ventilation fan mounting structure of claim 1, wherein: the connection members of the first bracket and the connection members of the second bracket are formed of resin material.

* * * * *